US011336009B2

(12) United States Patent
Kuwahara et al.

(10) Patent No.: US 11,336,009 B2
(45) Date of Patent: May 17, 2022

(54) ARRAY ANTENNA DEVICE AND COMMUNICATION DEVICE

(71) Applicant: Mitsubishi Electric Corporation, Tokyo (JP)

(72) Inventors: Takashi Kuwahara, Tokyo (JP); Tetsu Owada, Tokyo (JP); Narihiro Nakamoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/126,411

(22) Filed: Dec. 18, 2020

(65) Prior Publication Data

US 2021/0104817 A1 Apr. 8, 2021

Related U.S. Application Data

(63) Continuation of application No. PCT/JP2018/026219, filed on Jul. 11, 2018.

(51) Int. Cl.
*H01Q 3/32* (2006.01)

(52) U.S. Cl.
CPC ..... *H01Q 3/32* (2013.01)

(58) Field of Classification Search
CPC .. H01Q 3/32; H01Q 3/30; H01Q 3/26; H01Q 3/2605; H01Q 3/01
See application file for complete search history.

(56) References Cited

U.S. PATENT DOCUMENTS

| | | | | |
|---|---|---|---|---|
| 6,239,744 | B1 * | 5/2001 | Singer | H01Q 1/246 342/359 |
| 7,173,570 | B1 * | 2/2007 | Wensink | H01Q 1/125 343/760 |
| 2020/0044358 | A1 | 2/2020 | Nakamoto et al. | |

FOREIGN PATENT DOCUMENTS

| | | | |
|---|---|---|---|
| JP | 3-58504 | A | 3/1991 |
| JP | 5-336777 | A | 12/1993 |
| JP | 11-317619 | A | 11/1999 |
| JP | 2010-29013 | A | 2/2010 |
| JP | 2010029013 | A * | 2/2010 |
| WO | WO 2018/211695 | A1 | 11/2018 |
| WO | WO 2018/211747 | A1 | 11/2018 |

* cited by examiner

*Primary Examiner* — Dameon E Levi
*Assistant Examiner* — Leah Rosenberg
(74) *Attorney, Agent, or Firm* — Birch, Stewart, Kolasch & Birch, LLP

(57) ABSTRACT

An array antenna device includes a classifying unit that classifies rotating devices into a plurality of groups with different priorities under the condition that the number of rotating devices included in one group is equal to or less than the number of rotating devices that is calculated by a number-of-drivable-devices calculating unit; and a rotation instructing unit that selects groups in descending order of priority from among the plurality of groups and drives, each time one group is selected, all rotating devices included in the group, and the classifying unit performs the classification in such a manner that, among the rotating devices, a rotating device that rotates an element antenna with a higher importance level is classified into a group with a higher priority.

9 Claims, 12 Drawing Sheets

ARRAY ANTENNA DEVICE AND COMMUNICATION DEVICE

CROSS REFERENCE TO RELATED APPLICATION

This application is a Continuation of PCT International Application No. PCT/JP2018/026219, filed on Jul. 11, 2018, which is hereby expressly incorporated by reference into the present application.

TECHNICAL FIELD

The invention relates to an array antenna device including an array antenna, and a communication device including the array antenna device.

BACKGROUND ART

The following Patent Literature 1 discloses an antenna device including an electric motor that simultaneously rotates a plurality of circularly polarized antennas.

In the antenna device disclosed in the following Patent Literature 1, a single electric motor simultaneously rotates a plurality of gears coupled to rotating shafts of the respective plurality of circularly polarized antennas, and thereby simultaneously rotates the plurality of circularly polarized antennas.

By the single electric motor simultaneously rotating the plurality of circularly polarized antennas, the phases of output from the plurality of circularly polarized antennas can be adjusted.

CITATION LIST

Patent Literature

Patent Literature 1: JP 11-317619 A

SUMMARY OF INVENTION

Technical Problem

In the antenna device disclosed in Patent Literature 1, a single electric motor can simultaneously rotate the plurality of circularly polarized antennas.

However, since the electric motor cannot individually rotate the circularly polarized antennas, the phases of output from the respective circularly polarized antennas cannot be individually adjusted. In order to enable individual rotation of the circularly polarized antennas, a plurality of electric motors that rotate the rotating shafts of the respective circularly polarized antennas need to be mounted on the antenna device.

When a plurality of electric motors are mounted on the antenna device, current consumption increases, compared with a case in which a single electric motor is mounted, and the current consumption may exceed maximum allowed current consumption of the entire device. When the current consumption exceeds the maximum allowed current consumption of the entire device, the antenna device needs to limit the number of electric motors to be simultaneously driven, and there is a problem that the time required to start the formation of a main beam increases due to a delay caused by limiting the number of electric motors.

The invention is made to solve a problem such as that described above, and an object of the invention is to obtain an array antenna device and a communication device that can suppress an increase in the time required to start the formation of a main beam.

Solution to Problem

An array antenna device according to the invention includes: an array antenna including a plurality of element antennas; a plurality of rotating devices for each rotating a corresponding one of the plurality of element antennas; and processing circuitry to; calculate a number of rotating devices that are simultaneously drivable from maximum allowed current consumption of the entire device and current consumption of each of the plurality of rotating devices; classify the plurality of rotating devices into a plurality of groups with different priorities under a condition that the number of rotating devices included in one group is equal to or less than the number of the rotating devices that is calculated; and select groups in descending order of priority from among the plurality of groups and drive, each time one group is selected, all rotating devices included in the group, and the processing circuitry performs the classification in such a manner that, among the plurality of rotating devices, a rotating device that rotates an element antenna with a higher importance level is classified into a group with a higher priority.

Advantageous Effects of Invention

According to the invention, the array antenna device is configured in such a manner that the array antenna device includes the classifying unit that classifies the plurality of rotating devices into a plurality of groups with different priorities under the condition that the number of rotating devices included in one group is equal to or less than a number calculated by the number-of-drivable-devices calculating unit; and the rotation instructing unit that selects groups in descending order of priority from among the plurality of groups and drives, each time one group is selected, all rotating devices included in the group, and the classifying unit performs the classification in such a manner that, among the plurality of rotating devices, a rotating device that rotates an element antenna with a higher importance level is classified into a group with a higher priority. Thus, the array antenna device according to the invention can suppress an increase in the time required to start the formation of a main beam.

DESCRIPTION OF EMBODIMENTS

To describe the invention in more detail, modes for carrying out the invention will be described below by referring to the accompanying drawings.

First Embodiment

Figure 1:
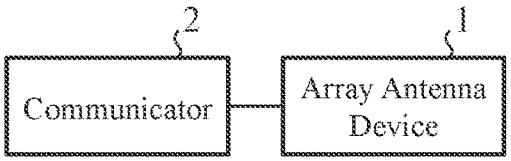
FIG. 1 is a configuration diagram showing a communication device including an array antenna device of a first embodiment.

FIG. 1 is a configuration diagram showing a communication device including an array antenna device of a first embodiment.

Figure 2:
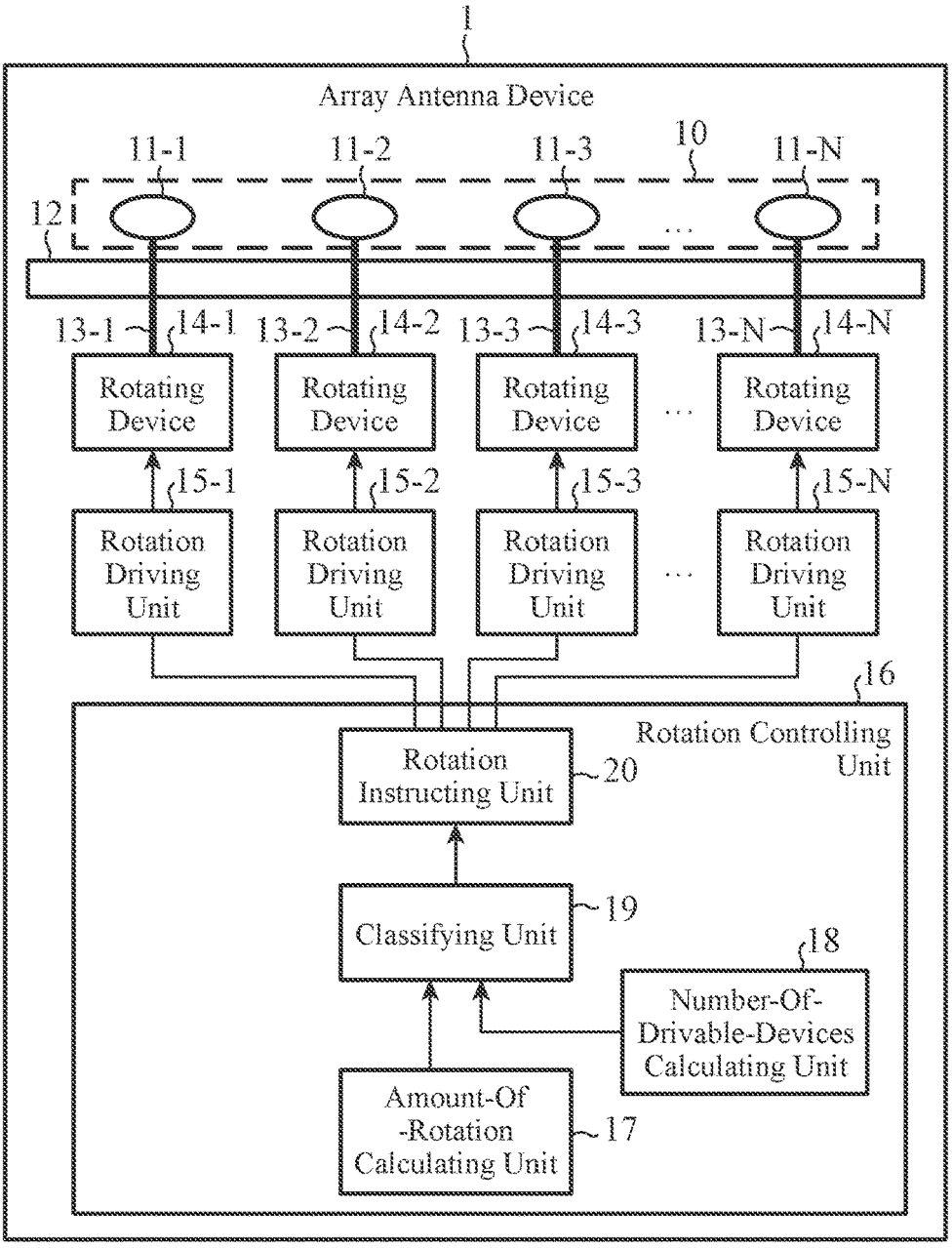
FIG. 2 is a configuration diagram showing the array antenna device of the first embodiment.

FIG. 2 is a configuration diagram showing the array antenna device of the first embodiment.

In FIGS. 1 and 2, an array antenna device 1 includes an array antenna 10 including N element antennas 11-1 to 11-N (N is an integer greater than or equal to 2).

When transmission signals are outputted from a communicator 2, the array antenna device 1 radiates the transmission signals as electromagnetic waves into space from the array antenna 10, and when the array antenna 10 receives electromagnetic waves, the array antenna device 1 outputs reception signals of the array antenna 10 to the communicator 2.

The communicator 2 is connected to a feeding unit 12 in the array antenna device 1.

The communicator 2 performs wireless communication by outputting transmission signals to the feeding unit 12 and obtaining reception signals from the feeding unit 12.

The array antenna 10 includes the element antennas 11-1 to 11-N.

The element antennas 11-1 to 11-N are arranged one-dimensionally or two-dimensionally.

The feeding unit 12 is a waveguide having holes that allow respective rotating shafts 13-1 to 13-N to pass therethrough, and is connected to the communicator 2.

The feeding unit 12 feeds transmission signals outputted from the communicator 2 to the element antennas 11-1 to 11-N, and outputs reception signals of the element antennas 11-1 to 11-N to the communicator 2.

The rotating shafts 13-1 to 13-N pass through the feeding unit 12.

At one end, the rotating shafts 13-1 to 13-N are connected to the element antennas 11-1 to 11-N. At the other end, the rotating shafts 13-1 to 13-N are connected to rotating devices 14-1 to 14-N.

The rotating devices 14-1 to 14-N are devices, each of which rotates one of the element antennas 11-1 to 11-N through the corresponding one of the rotating shafts 13-1 to 13-N.

The rotating devices 14-1 to 14-N correspond to electric motors such as stepping motors, direct-current motors, or alternating-current motors.

Rotation driving units 15-1 to 15-N are motor drivers that control each of the amounts of rotation of the rotating devices 14-1 to 14-N in accordance with control signals outputted from a rotation instructing unit 20.

A rotation controlling unit 16 is implemented by, for example, a semiconductor integrated circuit having mounted thereon a storage device such as a hard disk and a central processing unit (CPU).

The rotation controlling unit 16 includes an amount-of-rotation calculating unit 17, a number-of-drivable-devices calculating unit 18, a classifying unit 19, and the rotation instructing unit 20.

The amount-of-rotation calculating unit 17 calculates 1 each of the amounts of rotation $\theta_1$ to $\theta_N$ of the element antennas 11-1 to 11-N from a current beam direction and a new beam direction upon changing a beam direction of electromagnetic waves to be transmitted from or received by the array antenna 10.

The amount-of-rotation calculating unit 17 outputs each of the amounts of rotation $\theta_1$ to $\theta_N$ of the element antennas 11-1 to 11-N to the classifying unit 19.

The number-of-drivable-devices calculating unit 18 calculates the number M of rotating devices that can be simultaneously driven from maximum allowed current consumption $I_{max}$ of the entire array antenna device 1 and current consumption $I_c$ of each of the rotating devices 14-1 to 14-N.

The number-of-drivable-devices calculating unit 18 outputs the number M to the classifying unit 19.

In the array antenna device 1 shown in FIG. 2, it is assumed that the rotating devices 14-1 to 14-N all have the same current consumption $I_c$.

The classifying unit 19 classifies the rotating devices 14-1 to 14-N into a plurality of groups with different priorities under the condition that the number of rotating devices included in one group is equal to or less than the number M calculated by the number-of-drivable-devices calculating unit 18.

When the classifying unit 19 classifies the rotating devices 14-1 to 14-N into a plurality of groups with different priorities, the classifying unit 19 performs the classification in such a manner that, among the rotating devices 14-1 to 14-N, a rotating device that rotates an element antenna with a higher importance level is classified into a group with a higher priority.

The classifying unit 19 outputs results of the classification of the rotating devices 14-1 to 14-N to the rotation instructing unit 20.

The rotation instructing unit 20 selects groups in descending order of priority from among the plurality of groups by referring to the results of the classification outputted from the classifying unit 19.

Each time the rotation instructing unit 20 selects one group, the rotation instructing unit 20 generates control signals that simultaneously drive all rotating devices included in the group.

The rotation instructing unit 20 outputs the generated control signals to rotation driving units, among the rotation driving units 15-1 to 15-N, that are connected to all rotating devices included in the selected group.

Next, operation of the array antenna device 1 shown in FIG. 1 will be described.

Figure 3:
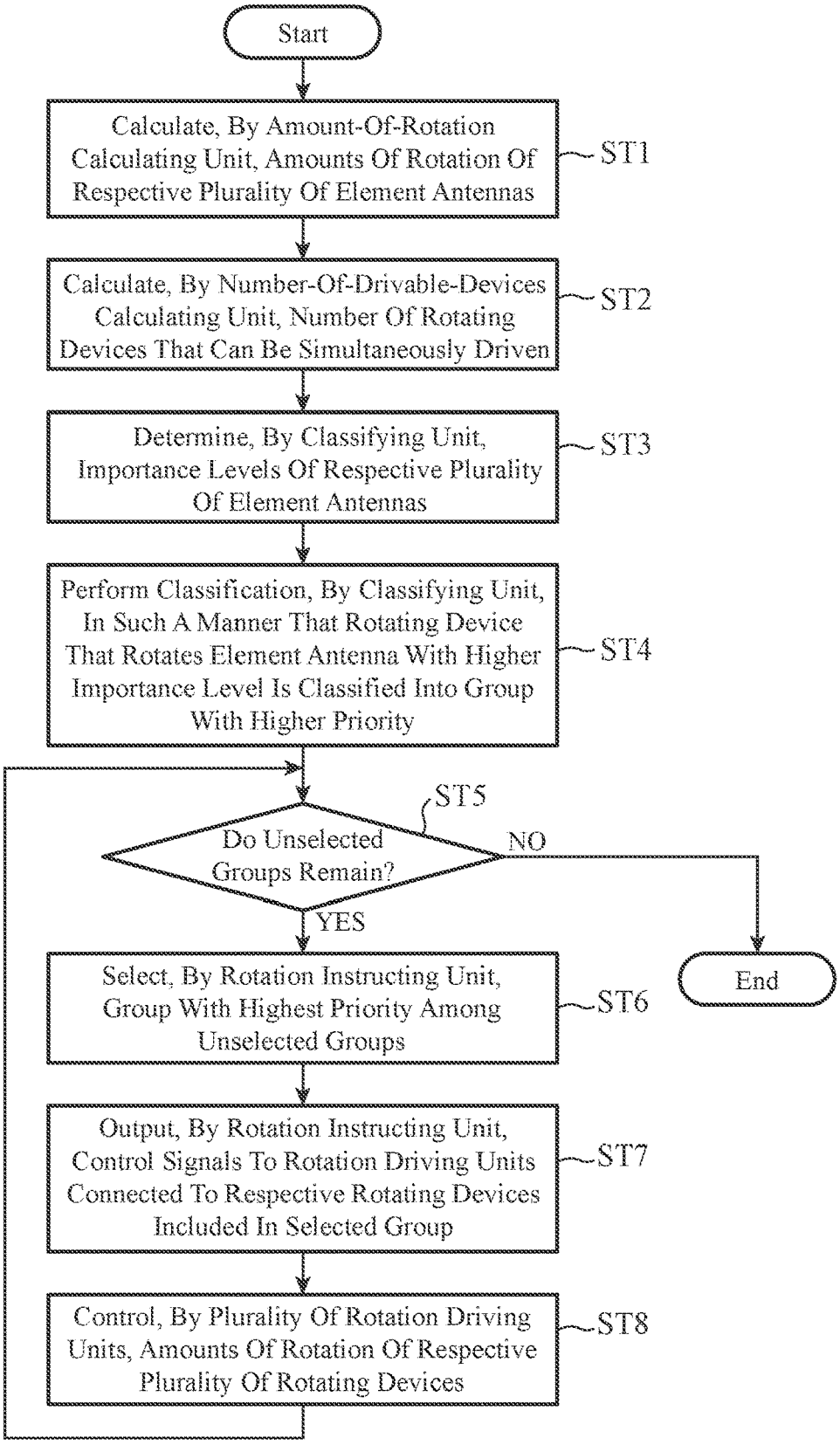
FIG. 3 is a flowchart showing operation of the array antenna device 1 shown in FIG. 1.

FIG. 3 is a flowchart showing operation of the array antenna device 1 shown in FIG. 1.

The amount-of-rotation calculating unit 17 obtains a current beam direction and a new beam direction from the communicator 2 or an external device which is not shown, upon changing a beam direction of electromagnetic waves to be transmitted from or received by the array antenna 10.

The amount-of-rotation calculating unit 17 calculates a difference between the current beam direction and the new beam direction, and calculates each of the amounts of rotation $\theta_1$ to $\theta_N$ of the element antennas 11-1 to 11-N from the difference (step ST1 of FIG. 3).

When an element antenna 11-*n* (n=1, 2, . . . , N) has only one rotation direction, the amount of rotation $\theta_n$ has a value in a range of $0° \leq \theta_n < 360°$. The one rotation direction is a clockwise direction or a counterclockwise direction.

When the element antenna 11-*n* has two rotation directions, the amount of rotation $\theta_n$ has a value in a range of $-180° \leq \theta_n < 180°$.

The process of calculating the amount of rotation $\theta_n$ from the difference between the current beam direction and the new beam direction itself is a publicly known technique and thus a detailed description thereof is omitted.

The amount-of-rotation calculating unit 17 outputs each of the amounts of rotation $\theta_1$ to $\theta_N$ of the element antennas 11-1 to 11-N to the classifying unit 19.

Here, it is assumed that each time the beam direction changes, the amount-of-rotation calculating unit 17 calculates the amounts of rotation $\theta_n$. However, the configuration is not limited thereto, and the amount-of-rotation calculating unit 17 may store therein a table showing a correspondence between differences between beam directions and the amounts of rotation $\theta_n$, and read out the amount of rotation $\theta_n$ associated with a difference between beam directions from the table.

The number-of-drivable-devices calculating unit 18 obtains maximum allowed current consumption $I_{max}$ of the entire array antenna device 1 and current consumption $I_c$ of each of the rotating devices 14-1 to 14-N.

The maximum allowed current consumption $I_{max}$ and the current consumption $I_c$ may be stored in an internal memory of the number-of-drivable-devices calculating unit 18 or may be provided from an external source.

In the array antenna device 1, current is also consumed by components other than the rotating devices 14-1 to 14-N. Since the current consumption of the components other than the rotating devices 14-1 to 14-N is very small compared to the current consumption of the rotating devices 14-1 to 14-N, the maximum allowed current consumption $I_{max}$ ignores the current consumption of the components other than the rotating devices 14-1 to 14-N.

The number-of-drivable-devices calculating unit 18 calculates the number M of rotating devices that can be simultaneously driven from the maximum allowed current consumption $I_{max}$ and the current consumption $I_c$ (step ST2 of FIG. 3).

Namely, the number-of-drivable-devices calculating unit 18 calculates the number M that satisfies the following expression (1) from the maximum allowed current consumption $I_{max}$ and the current consumption $I_c$. M is an integer greater than or equal to 1.

$$I_c \times M \leq I_{max} \tag{1}$$

The number-of-drivable-devices calculating unit 18 outputs the number M to the classifying unit 19.

When the classifying unit 19 receives the number M from the number-of-drivable-devices calculating unit 18, the classifying unit 19 determines that the number of rotating devices included in one group is M.

When the classifying unit 19 determines the number M, the classifying unit 19 classifies the rotating devices 14-1 to 14-N into G groups with different priorities.

$$G = ROUNDUP\left(\frac{N}{M}\right) \tag{2}$$

In equation (2), ROUNDUP (•) is a function that rounds up to the nearest whole number.

Here, the classifying unit 19 determines that the number of rotating devices included in one group is M. However, this is merely an example and the classifying unit 19 may determine that the number of rotating devices included in one group is less than M.

When the classifying unit 19 determines that the number of rotating devices included in one group is less than M, the current consumption of the entire device can be reduced, compared with a case in which the number of rotating devices included in one group is determined to be M, but the time required to complete rotation of the element antennas 11-1 to 11-N increases.

When the number N of the rotating devices 14-1 to 14-N is divisible by M, the numbers of rotating devices included in the G groups are all identical.

For example, when N=50 and M=10, the numbers of rotating devices included in five groups are all identical 10.

When the number N of the rotating devices 14-1 to 14-N is not divisible by M, only the number of rotating devices included in a group with the lowest priority is less than M.

For example, when N=58 and M=10, among six groups, only the number of rotating devices included in a group with the lowest priority is 8, and the numbers of rotating devices included in the other groups are all identical 10.

When the classifying unit 19 classifies the rotating devices 14-1 to 14-N into a plurality of groups with different priorities, the classifying unit 19 determines the importance levels $I_1$ to $I_N$ of the respective element antennas 11-1 to 11-N from the amounts of rotation $\theta_1$ to $\theta_N$ of the respective element antennas 11-1 to 11-N (step ST3 of FIG. 3).

Namely, since the classifying unit 19 determines that, among the element antennas 11-1 to 11-N, element antennas with larger amounts of rotation $\theta_1$ to $\theta_N$ have higher values of importance level, the classifying unit 19 determines the importance level $I_n$ by substituting the amount of rotation $\theta_n$ (n=1, 2, . . . , N) into a function X shown in the following equation (3):

$$I_n = X(\theta_n) \tag{3}$$

In equation (3), the function X is a function that returns the importance level $I_n$ that is directly proportional to the absolute value $|\theta_n|$ of the amount of rotation $\theta_n$.

The classifying unit 19 performs classification in such a manner that, among the rotating devices 14-1 to 14-N, a rotating device 14-*n* that rotates an element antenna 11-*n* with a higher importance level $I_n$ is classified into a group with a higher priority (step ST4 of FIG. 3).

When the classifying unit 19 classifies the rotating devices 14-1 to 14-N into, for example, a group $G_1$, a group $G_2$, and a group $G_3$, the group $G_1$ with the highest priority includes M top rotating devices with high importance levels $I_n$.

The group $G_2$ with the second highest priority includes M rotating devices with the (M+1)th to (2·M)th highest importance levels $I_n$, and the group $G_3$ with the lowest priority includes the other rotating devices with low importance levels $I_n$.

The classifying unit 19 outputs results of the classification of the rotating devices 14-1 to 14-N to the rotation instructing unit 20.

The results of the classification of the rotating devices 14-1 to 14-N include information indicating the groups including the rotating devices 14-1 to 14-N, information indicating the priorities of the respective groups, and the amounts of rotation $\theta_1$ to $\theta_N$ of the respective element antennas 11-1 to 11-N.

When the rotation instructing unit 20 receives the results of the classification from the classifying unit 19, the rotation instructing unit 20 checks whether or not unselected groups remain among the plurality of groups with different priorities (step ST5 of FIG. 3).

If unselected groups remain (if YES at step ST5 of FIG. 3), the rotation instructing unit 20 selects a group with the highest priority among the unselected groups by referring to the results of the classification outputted from the classifying unit 19 (step ST6 of FIG. 3).

When the rotation instructing unit 20 selects one group, the rotation instructing unit 20 checks all rotating devices included in the selected group by referring to the results of the classification.

Here, for convenience of description, the group selected by the rotation instructing unit 20 is represented as $G_{sel}$, and the rotating devices included in the group $G_{sel}$ are represented as $sel_1$ to $sel_M$.

The rotation instructing unit 20 generates control signals $C_1$ to $C_M$ that simultaneously drive the rotating devices $sel_1$ to $sel_M$ included in the group $G_{sel}$. The control signal $C_m$ (m=1, 2, . . . , M) is a control signal for rotating a rotating device $sel_m$ by $\theta_m$.

The rotation instructing unit 20 outputs the control signals $C_1$ to $C_M$ to rotation driving units, among the rotation driving units 15-1 to 15-N, that are connected to the rotating devices $sel_1$ to $sel_M$, respectively, included in the group $G_{sel}$ (step ST7 of FIG. 3).

When the plurality of rotation driving units connected to the rotating devices $sel_1$ to $sel_M$ included in the group $G_{sel}$ receive the control signals $C_1$ to $C_M$ from the rotation instructing unit 20, the plurality of rotation driving units simultaneously drive the rotating devices $sel_1$ to $sel_M$ included in the group $G_{sel}$.

In addition, the plurality of rotation driving units connected to the rotating devices $sel_1$ to $sel_M$ included in the group $G_{sel}$ control each of the amounts of rotation of the rotating devices $sel_1$ to $sel_M$ in accordance with the control signals $C_1$ to $C_M$ (step ST8 of FIG. 3).

Among the N element antennas 11-1 to 11-N, element antennas connected to the rotating devices $sel_1$ to $sel_M$ each are rotated by the amount of rotation $\theta_m$ by the corresponding rotating device $sel_m$.

If unselected groups remain (if YES at step ST5 of FIG. 3), the rotation instructing unit 20 and the rotation driving units 15-1 to 15-N repeatedly perform the processes at step ST6 to ST8.

If an unselected group does not remain (if NO at step ST5 of FIG. 3), the array antenna device 1 ends a series of processes.

Figure 4:
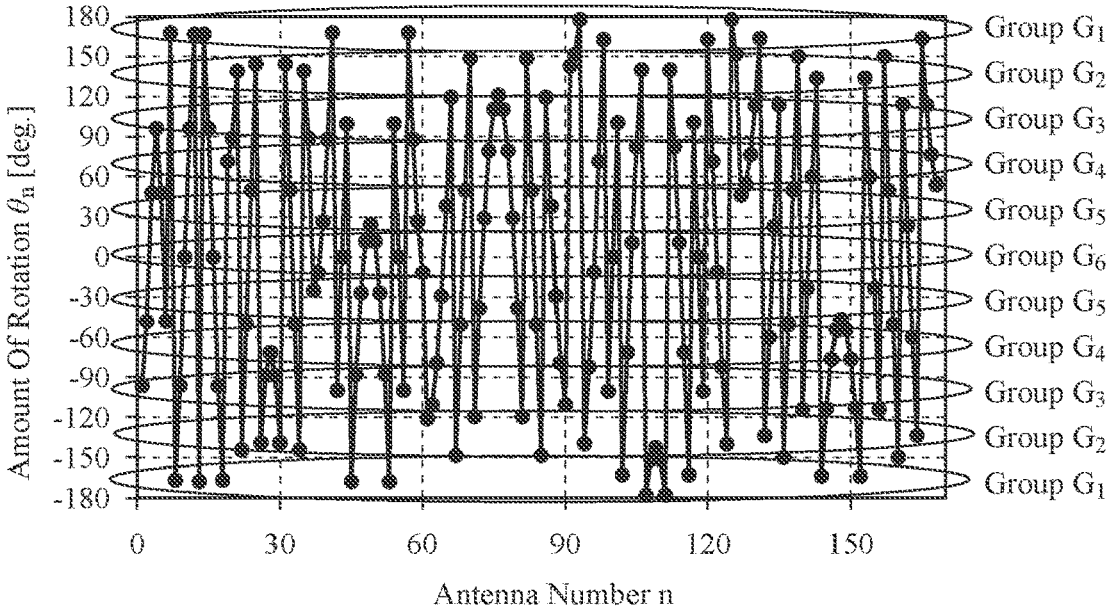
FIG. 4 is an explanatory diagram showing exemplary classification of rotating devices 14-1 to 14-N by a classifying unit 19.

Here, FIG. 4 is an explanatory diagram showing exemplary classification of the rotating devices 14-1 to 14-N by the classifying unit 19.

In FIG. 4, a horizontal axis represents an antenna number n (n=1, 2, . . . , N) of each of the element antennas 11-1 to 11-N rotated by the rotating devices 14-1 to 14-N, respectively.

A vertical axis represents the amount of rotation $\theta_n$ of each of the element antennas 11-1 to 11-N ($-180° \leq \theta_n < +180°$).

In FIG. 4, the rotating devices 14-1 to 14-N are classified by the classifying unit 19 into a group $G_1$, a group $G_2$, a group $G_3$, a group $G_4$, a group $G_5$, or a group $G_6$.

For the priorities of the group $G_1$, the group $G_2$, the group $G_3$, the group $G_4$, the group $G_5$, and the group $G_6$, as shown below, the group $G_1$ has the highest priority, the group $G_2$ has the second highest priority, and the group $G_6$ has the lowest priority. Group $G_1$>group $G_2$>group $G_3$>group $G_4$>group $G_5$>group $G_6$ In the example of FIG. 4, the classifying unit 19 classifies the rotating devices 14-1 to 14-N as follows:

The classifying unit 19 classifies a rotating device 14-*n* that rotates an element antenna 11-*n* whose amount of rotation $\theta_n$ is $+150° \leq \theta_n < +180°$ or $-180° \leq \theta_n < -150°$ into the group $G_1$. In the example of FIG. 4, for convenience of description, the number of rotating devices 14-*n* that rotate element antennas 11-*n* whose amounts of rotation $\theta_n$ are $+150° \leq \theta_n < +180°$ or $-180° \leq \theta_n < -150°$ is M.

The classifying unit 19 classifies a rotating device 14-*n* that rotates an element antenna 11-*n* whose amount of rotation $\theta_n$ is $+120° \leq \theta_n < +150°$ or $-150° \leq \theta_n < -120°$ into the group $G_2$. In the example of FIG. 4, for convenience of description, the number of rotating devices 14-*n* that rotate element antennas 11-*n* whose amounts of rotation $\theta_n$ are $+120° \leq \theta_n < +150°$ or $-150° \leq \theta_n < -120°$ is M.

In addition, the classifying unit 19 classifies a rotating device 14-*n* that rotates an element antenna 11-*n* whose amount of rotation $\theta_n$ is $+90° \leq \theta_n < +120°$ or $-120° \leq \theta_n < -90°$ into the group $G_3$. In the example of FIG. 4, for convenience of description, the number of rotating devices 14-*n* that rotate element antennas 11-*n* whose amounts of rotation $\theta_n$ are $+90° \leq \theta_n < +120°$ or $-120° \leq \theta_n < -90°$ is M.

The classifying unit 19 classifies a rotating device 14-*n* that rotates an element antenna 11-*n* whose amount of rotation $\theta_n$ is $+60° \leq \theta_n < +90°$ or $-90° \leq \theta_n < -60°$ into the group $G_4$. In the example of FIG. 4, for convenience of description, the number of rotating devices 14-*n* that rotate element antennas 11-*n* whose amounts of rotation $\theta_n$ are $+60° \leq \theta_n < +90°$ or $-90° \leq \theta_n < -60°$ is M.

In addition, the classifying unit 19 classifies a rotating device 14-*n* that rotates an element antenna 11-*n* whose amount of rotation $\theta_n$ is $+30° \leq \theta_n < +60°$ or $-60° \leq \theta_n < -30°$ into the group $G_5$. In the example of FIG. 4, for convenience of description, the number of rotating devices 14-*n* that rotate element antennas 11-*n* whose amounts of rotation $\theta_n$ are $+30° \leq \theta_n < +60°$ or $-60° \leq \theta_n < -30°$ is M.

Furthermore, the classifying unit 19 classifies a rotating device 14-*n* that rotates an element antenna 11-*n* whose amount of rotation $\theta_n$ is $-30° \leq \theta_n < +30°$ into the group $G_6$. In the example of FIG. 4, for convenience of description, the number of rotating devices 14-*n* that rotate element antennas 11-*n* whose amounts of rotation $\theta_n$ are $-30° \leq \theta_n < +30°$ is M.

When the number N of the rotating devices 14-1 to 14-N is, for example, 168, 30 rotating devices 14-*n* are classified into each of the group $G_1$, the group $G_2$, the group $G_3$, the group $G_4$, and the group $G_5$, and the other 18 rotating devices 14-*n* are classified into the group $G_6$.

FIG. 4 shows a summary of classification of the rotating devices 14-1 to 14-N by the classifying unit 19, and is not intended to show an example in which the number N of the rotating devices 14-1 to 14-N is 168.

Figure 5:
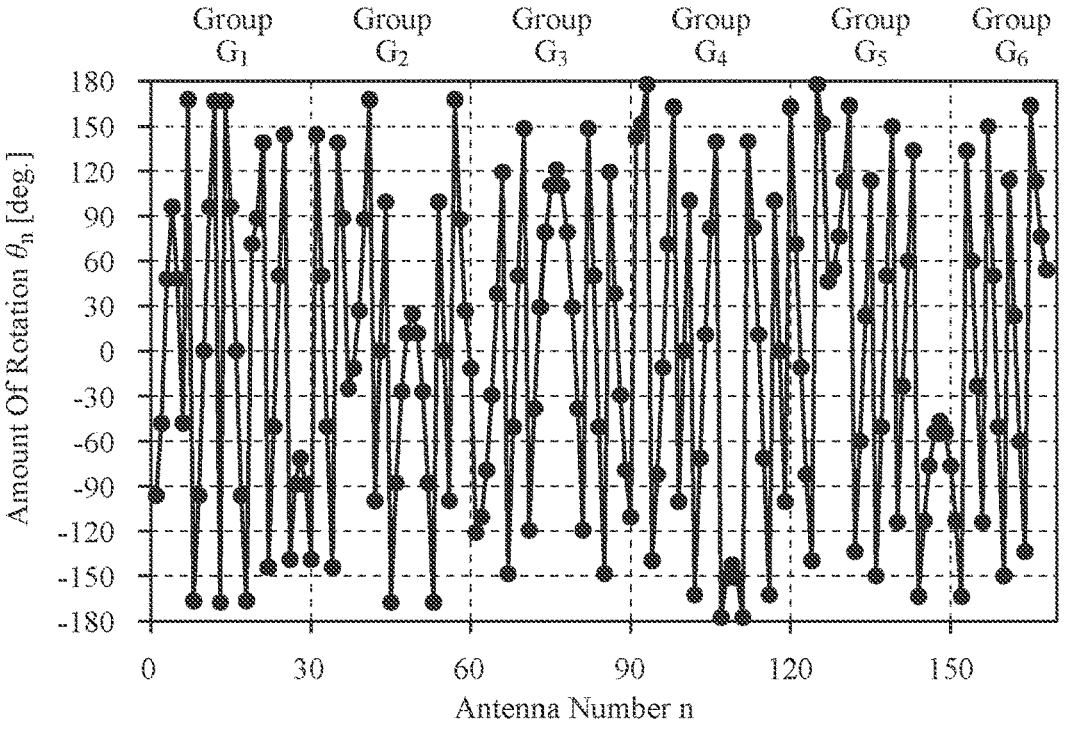
FIG. 5 is an explanatory diagram showing an example in which rotating devices are classified into groups in descending order of priority, starting from a rotating device 14-*n* that rotates an element antenna 11-*n* with the smallest antenna number n.

FIG. 5 is an explanatory diagram showing an example in which rotating devices 14-*n* that rotate element antennas 11-*n* with smaller antenna numbers n are classified, in turn, into groups with higher priorities, for comparison with the classification of the rotating devices 14-1 to 14-N by the classifying unit 19.

In FIG. 5, a horizontal axis represents an antenna number n (n=1, 2, . . . , N) of each of the element antennas 11-1 to 11-N rotated by the rotating devices 14-1 to 14-N, respectively.

A vertical axis represents the amount of rotation $\theta_n$ of each of the element antennas 11-1 to 11-N ($-180° \leq \theta_n < +180°$).

In the example of FIG. 5, the rotating devices 14-1 to 14-N are classified as follows:

A rotating device 14-*n* that rotates an element antenna 11-*n* whose antenna number n is $1 \leq n \leq 30$ is classified into a group $G_1$.

A rotating device 14-*n* that rotates an element antenna 11-*n* whose antenna number n is $31 \leq n \leq 60$ is classified into a group $G_2$.

A rotating device 14-*n* that rotates an element antenna 11-*n* whose antenna number n is $61 \leq n \leq 90$ is classified into a group $G_3$.

A rotating device 14-*n* that rotates an element antenna 11-*n* whose antenna number n is $91 \leq n \leq 120$ is classified into a group $G_4$.

A rotating device 14-*n* that rotates an element antenna 11-*n* whose antenna number n is $121 \leq n \leq 150$ is classified into a group $G_5$.

A rotating device 14-*n* that rotates an element antenna 11-*n* whose antenna number n is $151 \leq n$ is classified into a group $G_6$.

FIG. 5 also shows a summary of classification of the rotating devices 14-1 to 14-N, and is not intended to show an example in which the number N of the rotating devices 14-1 to 14-N is 168.

Formation of beam patterns at a time when the rotating devices 14-1 to 14-N are classified by the classifying unit 19 will be described.

FIGS. 6 to 10 show changes in beam patterns upon changing the beam direction by 20 degrees when the rotating devices 14-1 to 14-N are classified by the classifying unit 19.

Figure 6:
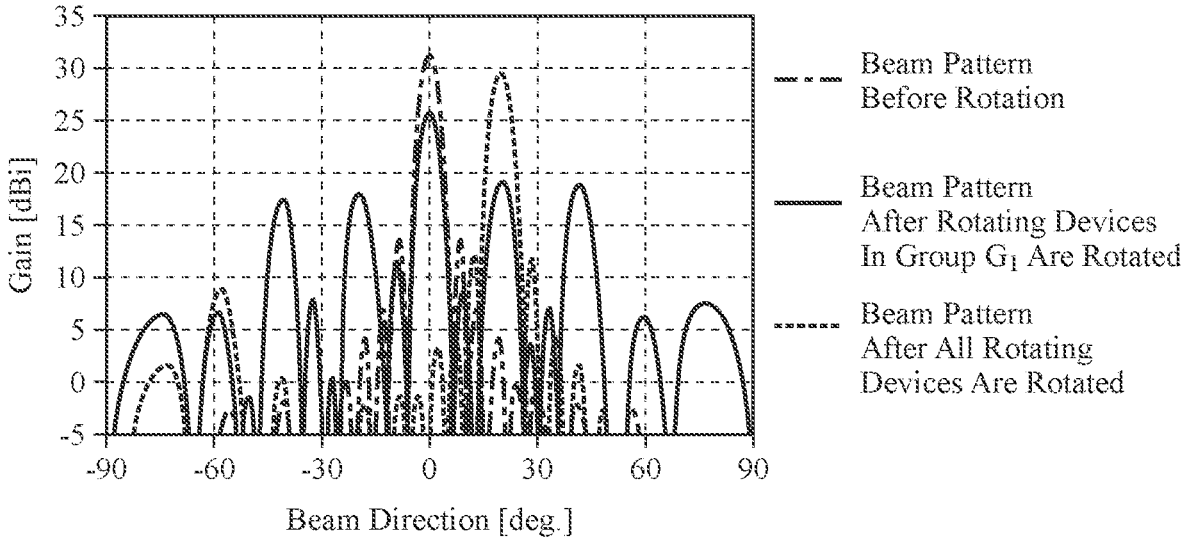
FIG. 6 is an explanatory diagram showing a beam pattern in a state in which element antennas 11-*n* are rotated by rotating devices 14-*n* included in a group $G_1$ when the rotating devices 14-1 to 14-N are classified by the classifying unit 19.

FIG. 6 is an explanatory diagram showing a beam pattern in a state in which element antennas 11-*n* are rotated by rotating devices 14-*n* included in the group $G_1$.

Figure 7:
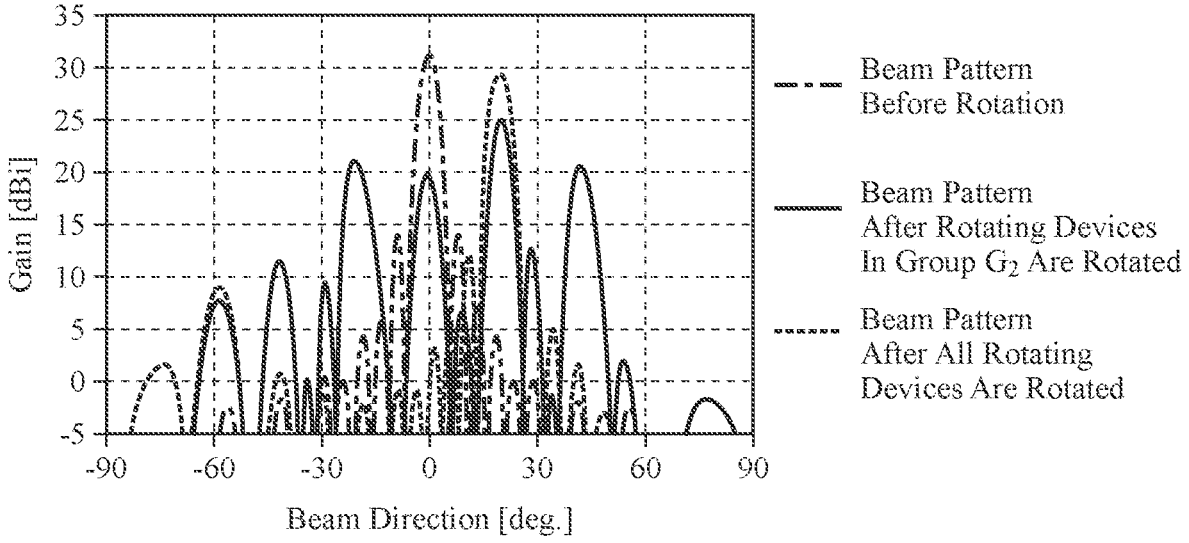
FIG. 7 is an explanatory diagram showing a beam pattern in a state in which element antennas 11-*n* are rotated by rotating devices 14-*n* included in a group $G_2$ when the rotating devices 14-1 to 14-N are classified by the classifying unit 19.

FIG. 7 is an explanatory diagram showing a beam pattern in a state in which element antennas 11-*n* are rotated by rotating devices 14-*n* included in the group $G_2$. In the state in which the element antennas 11-*n* are rotated by the rotating devices 14-*n* included in the group $G_2$, the rotation of the element antennas 11-*n* by the rotating devices 14-*n* included in the group $G_1$ is already completed.

Figure 8:
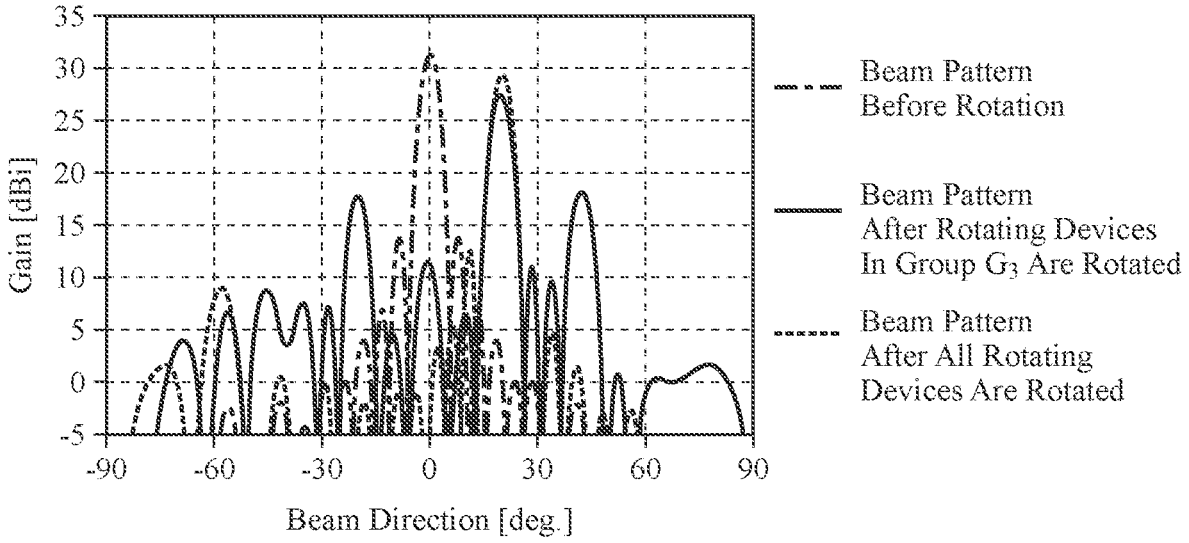
FIG. 8 is an explanatory diagram showing a beam pattern in a state in which element antennas 11-*n* are rotated by rotating devices 14-*n* included in a group $G_3$ when the rotating devices 14-1 to 14-N are classified by the classifying unit 19.

FIG. 8 is an explanatory diagram showing a beam pattern in a state in which element antennas 11-*n* are rotated by rotating devices 14-*n* included in the group $G_3$. In the state in which the element antennas 11-*n* are rotated by the rotating devices 14-*n* included in the group $G_3$, the rotation of the element antennas 11-*n* by the rotating devices 14-*n* included in the groups $G_1$ and $G_2$ is already completed.

Figure 9:
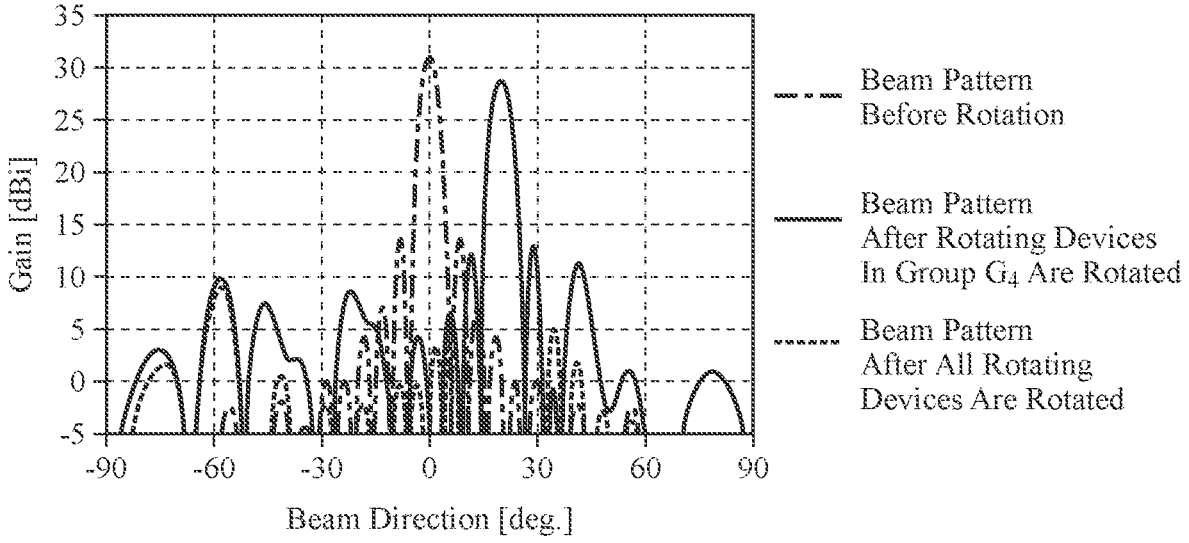
FIG. 9 is an explanatory diagram showing a beam pattern in a state in which element antennas 11-*n* are rotated by rotating devices 14-*n* included in a group $G_4$ when the rotating devices 14-1 to 14-N are classified by the classifying unit 19.

FIG. 9 is an explanatory diagram showing a beam pattern in a state in which element antennas 11-*n* are rotated by rotating devices 14-*n* included in the group $G_4$. In the state in which the element antennas 11-*n* are rotated by the rotating devices 14-*n* included in the group $G_4$, the rotation of the element antennas 11-*n* by the rotating devices 14-*n* included in the groups $G_1$, $G_2$, and $G_3$ is already completed.

Figure 10:
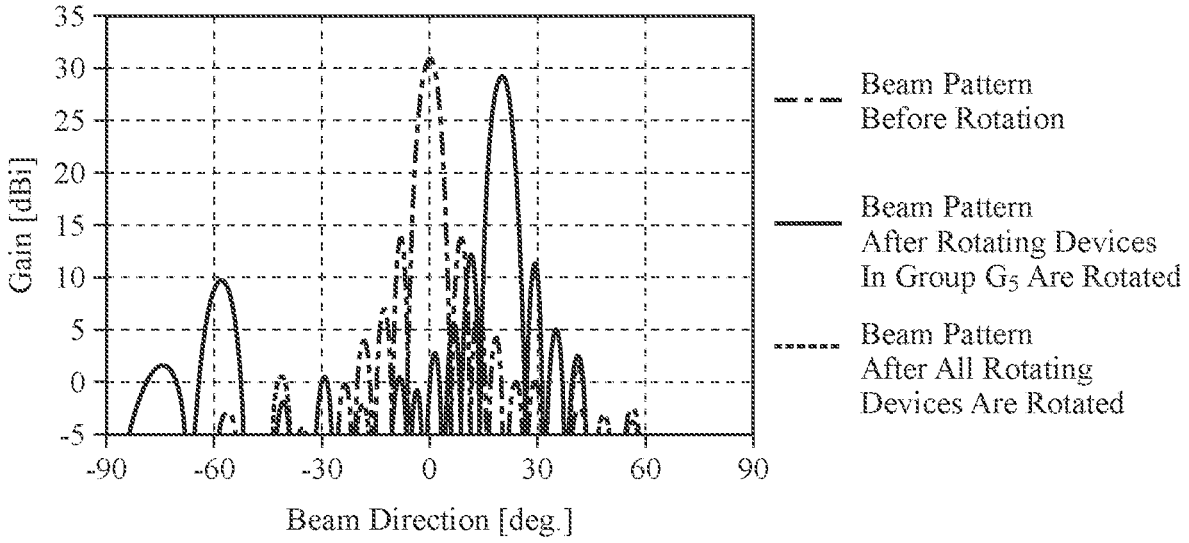
FIG. 10 is an explanatory diagram showing a beam pattern in a state in which element antennas 11-*n* are rotated by rotating devices 14-*n* included in a group $G_5$ when the rotating devices 14-1 to 14-N are classified by the classifying unit 19.

FIG. 10 is an explanatory diagram showing a beam pattern in a state in which element antennas 11-*n* are rotated by rotating devices 14-*n* included in the group $G_5$. In the state in which the element antennas 11-*n* are rotated by the rotating devices 14-*n* included in the group $G_5$, the rotation of the element antennas 11-*n* by the rotating devices 14-*n* included in the groups $G_1$, $G_2$, $G_3$, and $G_4$ is already completed.

In FIGS. 6 to 10, a horizontal axis represents the beam direction and a vertical axis represents the gain of the beam pattern.

A dashed-dotted line represents a beam pattern in a state before the rotating devices 14-1 to 14-N are rotated.

A solid line represents a beam pattern in a state in which element antennas 11-*n* are rotated by rotating devices 14-*n* included in the group $G_1$, the group $G_2$, the group $G_3$, the group $G_4$, or the group $G_5$.

A broken line represents a beam pattern in a state in which all element antennas 11-1 to 11-N are rotated by the rotating devices 14-1 to 14-N.

FIGS. 11 to 15 show changes in beam patterns upon changing the beam direction by 20 degrees when the rotating devices are classified into groups with higher priorities, starting from the rotating device 14-*n* that rotates an element antenna 11-*n* with the smallest antenna number n.

Figure 11:
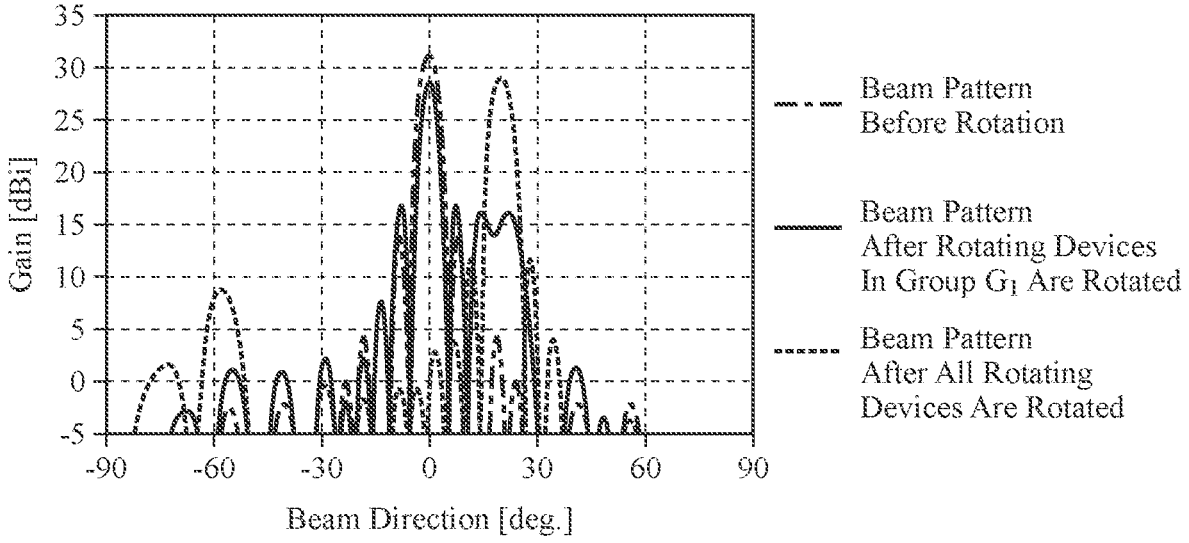
FIG. 11 is an explanatory diagram showing a beam pattern in a state in which element antennas 11-*n* are rotated by rotating devices 14-*n* included in the group $G_1$ when the rotating devices are classified in order from a rotating device that rotates an element antenna with the smallest antenna number.

FIG. 11 is an explanatory diagram showing a beam pattern in a state in which element antennas 11-*n* are rotated by rotating devices 14-*n* included in the group $G_1$.

Figure 12:
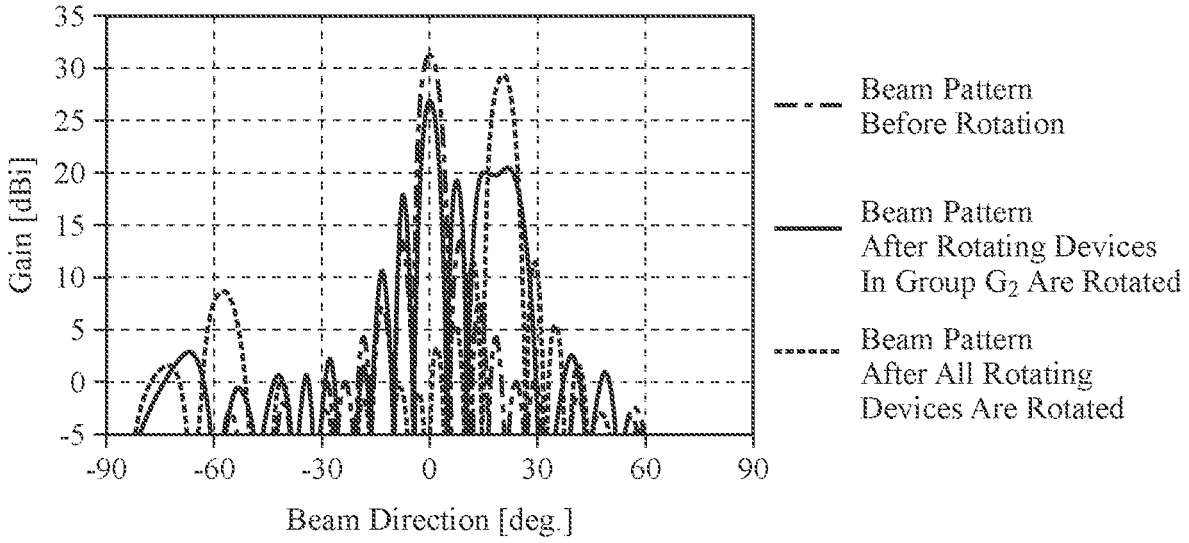
FIG. 12 is an explanatory diagram showing a beam pattern in a state in which element antennas 11-*n* are rotated by rotating devices 14-*n* included in the group $G_2$ when the rotating devices are classified in order from a rotating device that rotates an element antenna with the smallest antenna number.

FIG. 12 is an explanatory diagram showing a beam pattern in a state in which element antennas 11-*n* are rotated by rotating devices 14-*n* included in the group $G_2$. In the state in which the element antennas 11-*n* are rotated by the rotating devices 14-*n* included in the group $G_2$, the rotation of the element antennas 11-*n* by the rotating devices 14-*n* included in the group $G_1$ is already completed.

Figure 13:
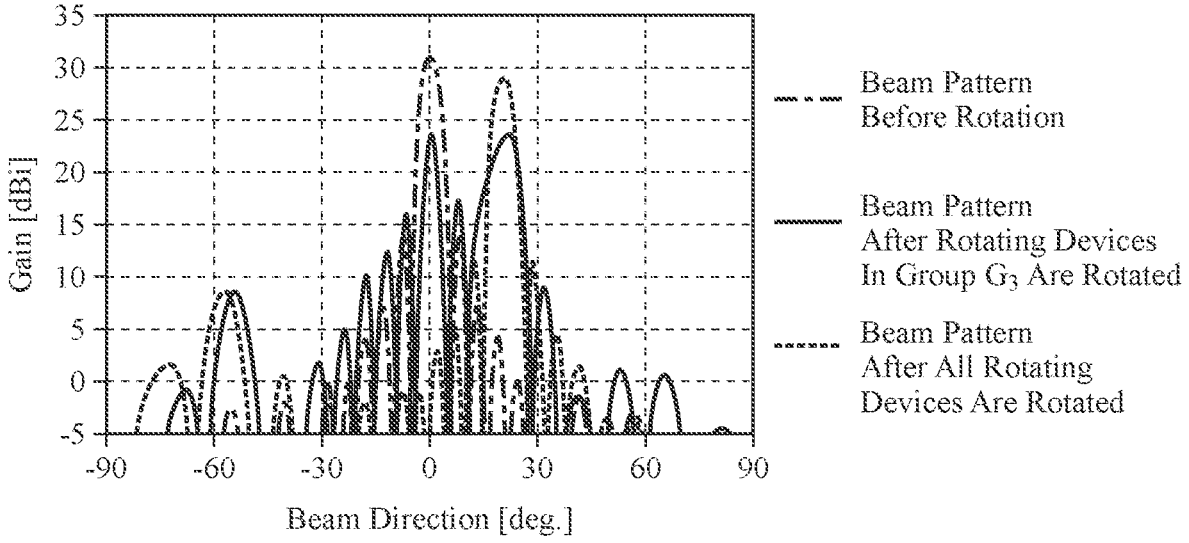
FIG. 13 is an explanatory diagram showing a beam pattern in a state in which element antennas 11-*n* are rotated by rotating devices 14-*n* included in the group $G_3$ when the rotating devices are classified in order from a rotating device that rotates an element antenna with the smallest antenna number.

FIG. 13 is an explanatory diagram showing a beam pattern in a state in which element antennas 11-*n* are rotated by rotating devices 14-*n* included in the group $G_3$. In the state in which the element antennas 11-*n* are rotated by the rotating devices 14-*n* included in the group $G_3$, the rotation of the element antennas 11-*n* by the rotating devices 14-*n* included in the groups $G_1$ and $G_2$ is already completed.

Figure 14:
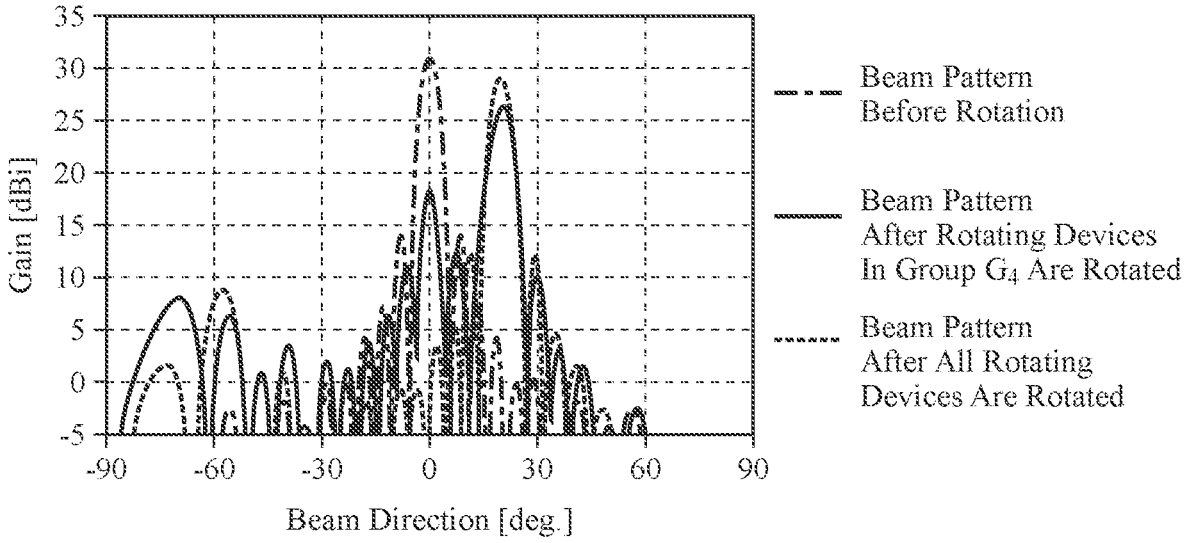
FIG. 14 is an explanatory diagram showing a beam pattern in a state in which element antennas 11-*n* are rotated by rotating devices 14-*n* included in the group $G_4$ when the rotating devices are classified in order from a rotating device that rotates an element antenna with the smallest antenna number.

FIG. 14 is an explanatory diagram showing a beam pattern in a state in which element antennas 11-*n* are rotated by rotating devices 14-*n* included in the group $G_4$. In the state in which the element antennas 11-*n* are rotated by the rotating devices 14-*n* included in the group $G_4$, the rotation of the element antennas 11-*n* by the rotating devices 14-*n* included in the groups $G_1$, $G_2$, and $G_3$ is already completed.

Figure 15:
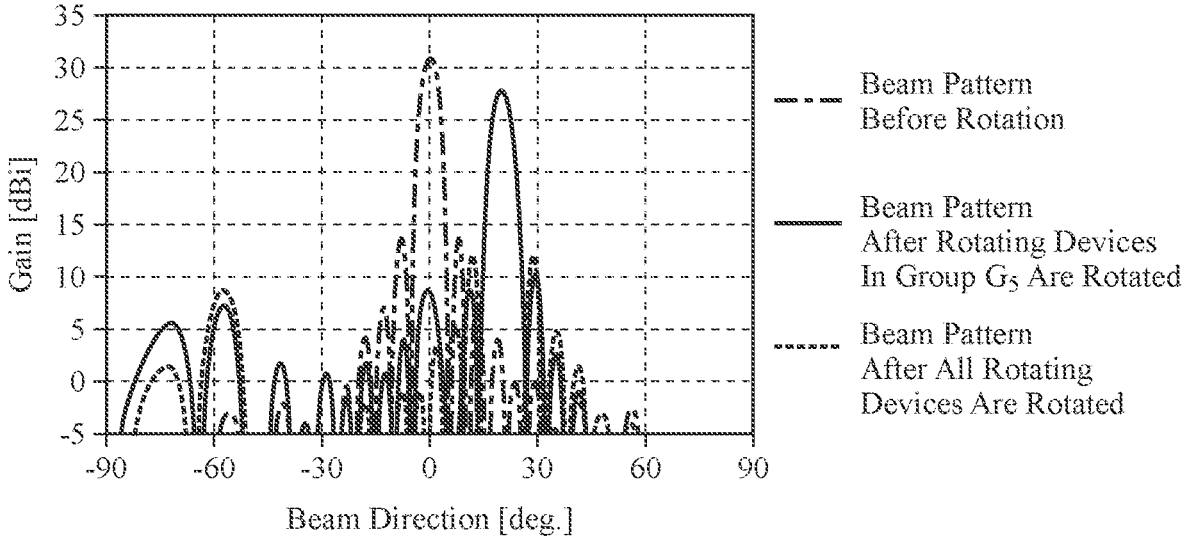
FIG. 15 is an explanatory diagram showing a beam pattern in a state in which element antennas 11-*n* are rotated by rotating devices 14-*n* included in the group $G_5$ when the rotating devices are classified in order from a rotating device that rotates an element antenna with the smallest antenna number.

FIG. 15 is an explanatory diagram showing a beam pattern in a state in which element antennas 11-*n* are rotated by rotating devices 14-*n* included in the group $G_5$. In the state in which the element antennas 11-*n* are rotated by the rotating devices 14-*n* included in the group $G_5$, the rotation of the element antennas 11-*n* by the rotating devices 14-*n* included in the groups $G_1$, $G_2$, $G_3$, and $G_4$ is already completed.

In FIGS. 11 to 15, a horizontal axis represents the beam direction and a vertical axis represents the gain of the beam pattern.

A dashed-dotted line represents a beam pattern in a state before the rotating devices 14-1 to 14-N are rotated.

A solid line represents a beam pattern in a state in which element antennas 11-*n* are rotated by rotating devices 14-*n* included in the group $G_1$, the group $G_2$, the group $G_3$, the group $G_4$, or the group $G_5$.

A broken line represents a beam pattern in a state in which all element antennas 11-1 to 11-N are rotated by the rotating devices 14-1 to 14-N.

Comparing FIGS. 6 to 10 with FIGS. 11 to 15, it can be seen that when the rotating devices 14-1 to 14-N are classified by the classifying unit 19, a main beam starts to be formed in a 20° direction at an earlier stage than when the rotating devices 14-1 to 14-N are classified on the basis of the antenna number n.

When the rotating devices 14-1 to 14-N are classified by the classifying unit 19, as shown in FIG. 7, substantially, in the state in which the element antennas 11-*n* are rotated by the rotating devices 14-*n* included in the group $G_2$, a main beam starts to be formed in the 20° direction.

When the rotating devices 14-1 to 14-N are classified on the basis of the antenna number n, as shown in FIG. 14, substantially, in the state in which the element antennas 11-*n* are rotated by the rotating devices 14-*n* included in the group $G_4$, a main beam starts to be formed in the 20° direction.

Once the main beam has started to be formed in the 20° direction, transmission and reception of electromagnetic waves in the 20° direction become possible.

Note that the beam pattern in the state in which all element antennas 11-1 to 11-N are rotated by the rotating devices 14-1 to 14-N is the same for both cases.

Next, the time required to complete rotation of all element antennas 11-1 to 11-N by the rotating devices 14-1 to 14-N will be described.

For example, when 180 rotating devices 14-1 to 14-N are classified into six groups, the six groups each include 30 rotating devices.

When the 180 rotating devices 14-1 to 14-N are classified in order from a rotating device 14-*n* that rotates an element antenna 11-*n* with the smallest antenna number n, six groups each may include a rotating device having a maximum amount of rotation $\theta_n$. When the element antenna 11-*n* has only one rotation direction, the maximum amount of rotation $\theta_n$ is 359°. When the element antenna 11-*n* has two rotation directions, the maximum amount of rotation $\theta_n$ is −180°.

When the six groups each include a rotating device having the maximum amount of rotation $\theta_n$, even if rotation by a rotating device whose amount of rotation $\theta_n$ is smaller than the maximum amount of rotation is completed, it is necessary to wait for rotation by the rotating device having the maximum amount of rotation $\theta_n$ to complete.

Namely, the time required for rotation by a rotating device having the maximum amount of rotation $\theta_n$ is longer than the time required for rotation by a rotating device whose amount of rotation $\theta_n$ is smaller than the maximum amount of rotation, and thus, even if rotation by a rotating device whose amount of rotation $\theta_n$ is smaller than the maximum amount of rotation is completed, until rotation by a rotating device having the maximum amount of rotation $\theta_n$ is completed, a process for a group including the rotating device having the maximum amount of rotation $\theta_n$ does not complete. Therefore, even if rotation by a rotating device whose amount of rotation $\theta_n$ is smaller than the maximum amount of rotation is completed, it is necessary to wait until rotation by a rotating device having the maximum amount of rotation $\theta_n$ is completed.

Thus, the time required for a process for each of the six groups may be the time required for rotation by a rotating device having the maximum amount of rotation $\theta_n$.

When the 180 rotating devices 14-1 to 14-N are classified by the classifying unit 19, among the six groups, a group with the highest priority may include a rotating device having the maximum amount of rotation $\theta_n$.

However, it is not likely that the other five groups include a rotating device having the maximum amount of rotation $\theta_n$.

Therefore, a process for the other five groups may be completed at a stage at which rotation by a rotating device whose amount of rotation $\theta_n$ is smaller than the maximum amount of rotation is completed.

When a process for a given group is completed, a process for a group whose priority is lower by one level than that of the given group can start, and thus, the time required to complete rotation of all element antennas 11-1 to 11-N is reduced.

In the above-described first embodiment, the array antenna device 1 is configured in such a manner that the array antenna device 1 includes the classifying unit 19 that classifies the rotating devices 14-1 to 14-N into a plurality of groups with different priorities under the condition that the number of rotating devices included in one group is equal to or less than a number calculated by the number-of-drivable-devices calculating unit 18; and the rotation instructing unit 20 that selects groups in descending order of priority from among the plurality of groups and drives, each time one group is selected, all rotating devices included in the group, and the classifying unit 19 performs the classification in such a manner that, among the rotating devices 14-1 to 14-N, a rotating device that rotates an element antenna with a higher importance level is classified into a group with a higher priority. Thus, the array antenna device 1 can suppress an increase in the time required to start the formation of a main beam.

Second Embodiment

In the array antenna device 1 of the first embodiment, the classifying unit 19 determines the importance levels $I_1$ to $I_N$ of the respective element antennas 11-1 to 11-N from the amounts of rotation $\theta_1$ to $\theta_N$ of the respective element antennas 11-1 to 11-N.

In a second embodiment, a classifying unit 30 calculates distances $L_1$ to $L_N$ between a center position $P_c$ of the element antennas 11-1 to 11-N and positions $P_1$ to $P_N$ of the respective element antennas 11-1 to 11-N. Then, an array antenna device 1 in which the classifying unit 30 determines the importance levels $I_1$ to $I_N$ of the respective element antennas 11-1 to 11-N from the distances $L_1$ to $L_N$ will be described.

Figure 16:
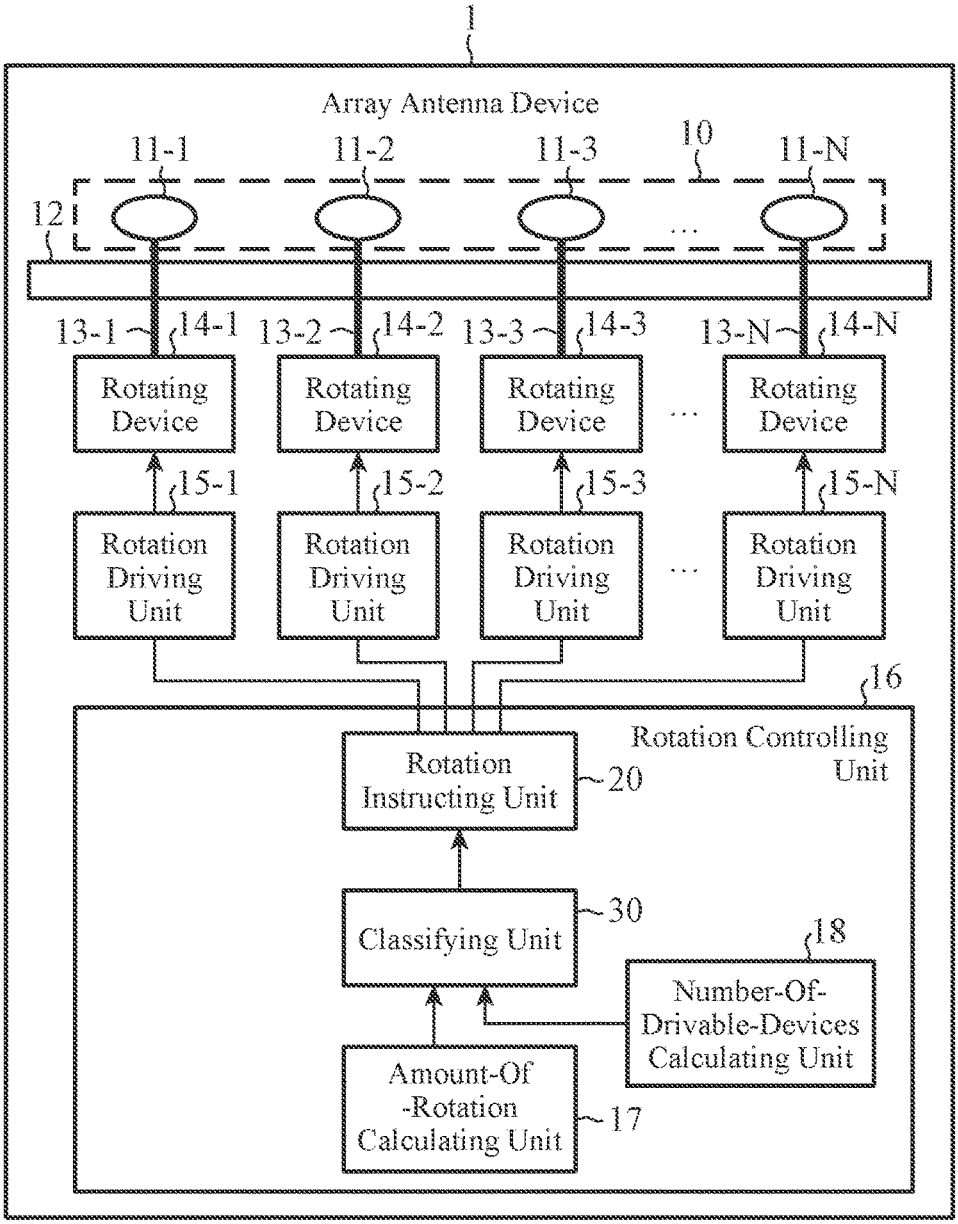
FIG. 16 is a configuration diagram showing an array antenna device of a second embodiment.

FIG. 16 is a configuration diagram showing an array antenna device of the second embodiment.

In FIG. 16, the same reference signs as those in FIG. 2 indicate the same or corresponding portions and thus description thereof is omitted.

The rotation controlling unit 16 includes the amount-of-rotation calculating unit 17, the number-of-drivable-devices calculating unit 18, the classifying unit 30, and the rotation instructing unit 20.

As with the classifying unit 19 shown in FIG. 2, the classifying unit 30 classifies the rotating devices 14-1 to 14-N into a plurality of groups with different priorities under the condition that the number of rotating devices included in one group is equal to or less than a number M calculated by the number-of-drivable-devices calculating unit 18.

As with the classifying unit 19 shown in FIG. 2, when the classifying unit 30 classifies the rotating devices 14-1 to 14-N into a plurality of groups with different priorities, the classifying unit 30 performs the classification in such a manner that, among the rotating devices 14-1 to 14-N, a rotating device that rotates an element antenna with a higher importance level is classified into a group with a higher priority.

The classifying unit 30 outputs results of the classification of the rotating devices 14-1 to 14-N to the rotation instructing unit 20.

Note, however, that unlike the classifying unit 19 shown in FIG. 2, the classifying unit 30 calculates distances $L_1$ to $L_N$ between the center position $P_c$ of the element antennas 11-1 to 11-N and the positions $P_1$ to $P_N$ of the respective element antennas 11-1 to 11-N.

The classifying unit 30 determines importance levels $I_1$ to $I_N$ of the respective element antennas 11-1 to 11-N from the distances $L_1$ to $L_N$.

The classifying unit 30 determines that, among the element antennas 11-1 to 11-N, element antennas with shorter distances $L_1$ to $L_N$ have higher values of importance level.

Next, operation of the array antenna device 1 shown in FIG. 16 will be described.

Components other than the classifying unit 30 are the same as those of the array antenna device 1 shown in FIG. 2, and thus, here, only operation of the classifying unit 30 will be described.

Figure 17:
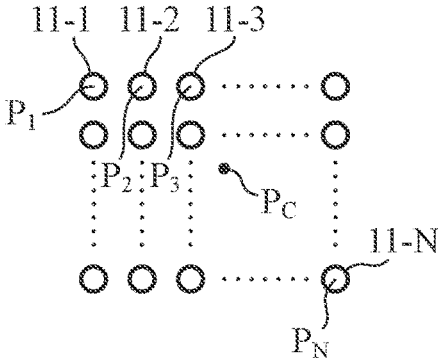
FIG. 17 is an explanatory diagram showing an exemplary arrangement of element antennas 11-1 to 11-N.

As shown in FIG. 17, the element antennas 11-1 to 11-N are arranged two-dimensionally. Note, however, that this is merely an example and the element antennas 11-1 to 11-N may be arranged one-dimensionally.

FIG. 17 is an explanatory diagram showing an exemplary arrangement of the element antennas 11-1 to 11-N.

In FIG. 17, $P_c$ is the center position of the element antennas 11-1 to 11-N, and $P_n$ (n=1, 2, . . . , N) is the position of an element antenna 11-*n*.

An internal memory of the classifying unit 30 stores therein the positions $P_1$ to $P_N$ of the element antennas 11-1 to 11-N arranged two-dimensionally.

Among the element antennas 11-1 to 11-N, an element antenna whose arrangement position is closer to the center position $P_c$ exerts greater influence on the formation of a beam pattern. Therefore, among the element antennas 11-1 to 11-N, an element antenna whose arrangement position is closer to the center position $P_c$ has a higher importance level $I_n$.

First, the classifying unit 30 calculates the center position $P_c$ of the element antennas 11-1 to 11-N.

A process of calculating the center position $P_c$ of the element antennas 11-1 to 11-N itself is a publicly known technique and thus a detailed description thereof is omitted.

Then, the classifying unit 30 calculates the distances $L_1$ to $L_N$ between the center position $P_c$ and the positions $P_1$ to $P_N$ of the respective element antennas 11-1 to 11-N as shown in the following equation (4):

$$L_n=\sqrt{(P_{c,x}-P_{n,x})^2+(P_{c,y}-P_{n,y})^2} \tag{4}$$

In equation (4), $P_{c,x}$ is the x-coordinate of the center position $P_c$, and $P_{c,y}$ is the y-coordinate of the center position $P_c$.

$P_{n,x}$ is the x-coordinate of the position $P_n$ of the element antenna 11-*n*, and $P_{n,y}$ is the y-coordinate of the position $P_n$ of the element antenna 11-*n*.

The classifying unit 30 determines the importance levels $I_1$ to $I_N$ of the respective element antennas 11-1 to 11-N from the distances $L_1$ to $L_N$.

Namely, since the classifying unit 30 determines that, among the element antennas 11-1 to 11-N, element antennas with shorter distances $L_1$ to $L_N$ have higher values of importance level, the classifying unit 30 determines the importance level $I_n$ by substituting the distance $L_n$ into a function Z shown in the following equation (5):

$$I_n=Z(L_n) \tag{5}$$

In equation (5), the function Z is a function that returns the importance level $I_n$ that is inversely proportional to the distance $L_n$.

As with the classifying unit 19 shown in FIG. 2, the classifying unit 30 performs classification in such a manner that, among the rotating devices 14-1 to 14-N, a rotating device 14-*n* that rotates an element antenna 11-*n* with a higher importance level $I_n$ is classified into a group with a higher priority.

The classifying unit 30 outputs results of the classification of the rotating devices 14-1 to 14-N to the rotation instructing unit 20.

The results of the classification of the rotating devices 14-1 to 14-N include information indicating the groups including the rotating devices 14-1 to 14-N, information indicating the priorities of the respective groups, and the amounts of rotation $\theta_1$ to $\theta_N$ of the respective element antennas 11-1 to 11-N.

In the above-described second embodiment, the array antenna device 1 is configured in such a manner that the classifying unit 30 determines the importance levels $I_1$ to $I_N$ of the respective element antennas 11-1 to 11-N from the distances $L_1$ to $L_N$ between the center position $P_c$ of the element antennas 11-1 to 11-N and the positions $P_1$ to $P_N$ of the respective element antennas 11-1 to 11-N. Thus, as with the array antenna device 1 of the first embodiment, the array antenna device 1 of the second embodiment can suppress an increase in the time required to start the formation of a main beam.

Third Embodiment

In a third embodiment, a classifying unit 41 assigns, as allocation numbers for a plurality of rotating devices included in a group with an odd-numbered priority, allocation numbers corresponding to descending order of the importance levels of element antennas each rotated by a corresponding one of the plurality of rotating devices.

In addition, an array antenna device 1 in which the classifying unit 41 assigns, as allocation numbers for a plurality of rotating devices included in a group with an even-numbered priority, allocation numbers corresponding to ascending order of the importance levels of element antennas each rotated by a corresponding one of the plurality of rotating devices will be described.

Figure 18:
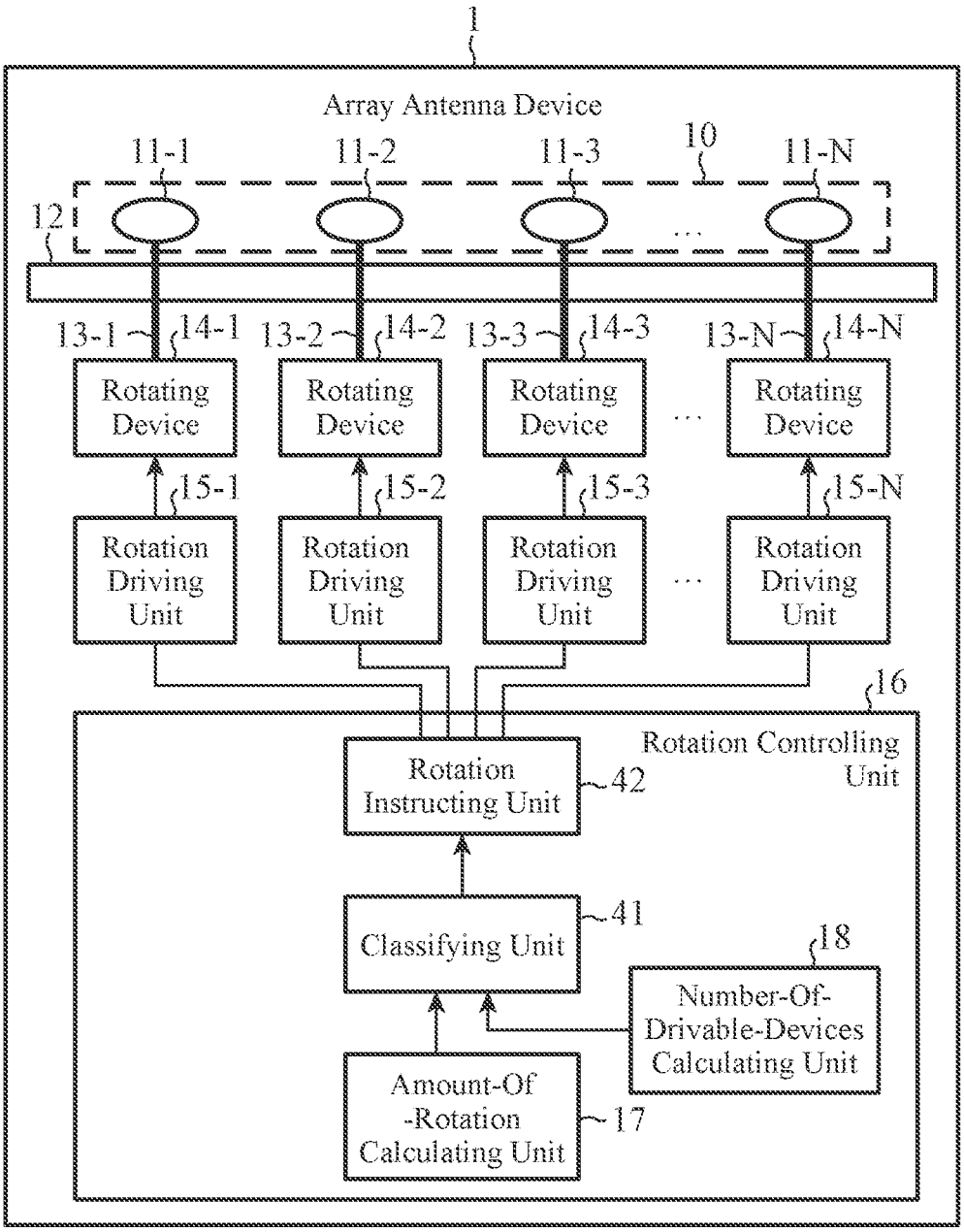
FIG. 18 is a configuration diagram showing an array antenna device of a third embodiment.

FIG. 18 is a configuration diagram showing an array antenna device of the third embodiment.

In FIG. 18, the same reference signs as those in FIG. 2 indicate the same or corresponding portions and thus description thereof is omitted.

The rotation controlling unit 16 includes the amount-of-rotation calculating unit 17, the number-of-drivable-devices calculating unit 18, the classifying unit 41, and a rotation instructing unit 42.

The classifying unit 41 determines allocation numbers k (k=1, 2, . . . , M) for M rotating devices included in a group $G_j$ with an odd-numbered priority (j=1, 3, . . . , G−1) among G groups. Here, for convenience of description, it is assumed that G which is the number of groups is an even number, and the numbers of rotating devices included in the respective G groups are all identical M.

Namely, the classifying unit 41 assigns, as allocation numbers k for M rotating devices, allocation numbers corresponding to descending order of the importance levels of element antennas each rotated by a corresponding one of the M rotating devices included in a group $G_j$ with an odd-numbered priority.

The classifying unit 41 determines allocation numbers k for M rotating devices included in a group $G_{j+1}$ (j=1, 3, . . . , G−1) with an even-numbered priority among the G groups.

Namely, the classifying unit 41 assigns, as allocation numbers k for M rotating devices, allocation numbers corresponding to ascending order of the importance levels of element antennas each rotated by a corresponding one of the M rotating devices included in a group $G_{j+1}$ with an even-numbered priority.

The rotation instructing unit 42 selects groups in descending order of priority from among the plurality of groups by referring to results of classification outputted from the classifying unit 41.

As with the rotation instructing unit 20 shown in FIG. 2, each time the rotation instructing unit 42 selects one group, the rotation instructing unit 42 generates control signals that drive all rotating devices included in the group.

When rotation of an element antenna rotated by any one of the rotating devices included in the selected group is completed, the rotation instructing unit 42 starts a process for a group whose priority is lower by one level than the selected group, without waiting for a process for the selected group to complete.

Namely, the rotation instructing unit 42 drives a rotating device that is one of a plurality of rotating devices included in the group whose priority is lower by one level than the selected group and that has the same allocation number as the rotating device whose corresponding element antenna has completed its rotation.

Next, operation of the array antenna device 1 shown in FIG. 18 will be described.

Components other than the classifying unit 41 and the rotation instructing unit 42 are the same as those of the array antenna device 1 shown in FIG. 2, and thus, here, only operation of the classifying unit 41 and the rotation instructing unit 42 will be described.

As with the classifying unit 19 shown in FIG. 2, the classifying unit 41 determines the importance levels $I_1$ to $I_N$ of the respective element antennas 11-1 to 11-N. Therefore, among the element antennas 11-1 to 11-N, element antennas 11-*n* with larger amounts of rotation $\theta_n$ have higher importance levels $I_1$ to $I_N$.

As with the classifying unit 19 shown in FIG. 2, the classifying unit 41 performs classification in such a manner that, among the rotating devices 14-1 to 14-N, a rotating device 14-*n* that rotates an element antenna 11-*n* with a higher importance level $I_n$ is classified into a group with a higher priority.

The classifying unit 41 assigns allocation numbers k to a plurality of rotating devices included in each group.

The classifying unit 41 assigns allocation numbers k for M rotating devices included in a group $G_j$ with an odd-numbered priority as follows.

Here, for convenience of description, it is assumed that a plurality of rotating devices included in a group $G_j$ with an odd-numbered priority are rotating devices 14-1 to 14-M.

In addition, it is assumed that element antennas each rotated by a corresponding one of the rotating devices 14-1 to 14-M are element antennas 11-1 to 11-M, and the importance levels of the element antennas 11-1 to 11-M are $I_1$ to $I_M$.

In addition, the scale of the importance levels $I_1$ to $I_M$ is as follows: among the importance levels $I_1$ to $I_M$, the importance level $I_1$ is highest, the importance level $I_2$ is second highest, and the importance level $I_M$ is lowest.

$$I_1 > I_2 > \ldots > I_M$$

The classifying unit 41 assigns, as allocation numbers k for the rotating devices 14-1 to 14-M included in the group $G_j$, allocation numbers corresponding to descending order of the importance levels $I_1$ to $I_M$ of the element antennas 11-1 to 11-M rotated by the rotating devices 14-1 to 14-M, respectively.

Namely, the classifying unit 41 assigns the allocation number "1" (k=1) to the rotating device 14-1 that rotates the element antenna 11-1 with the highest importance level $I_1$.

The classifying unit 41 assigns the allocation number "2" (k=2) to the rotating device 14-2 that rotates the element antenna 11-2 with the second highest importance level $I_2$.

In addition, the classifying unit 41 assigns the allocation number "M" (k=M) to the rotating device 14-M that rotates the element antenna 11-M with the lowest importance level $I_M$.

The classifying unit 41 assigns allocation numbers k for M rotating devices included in a group $G_{j+1}$ (j=1, 3, . . . , J−1) with an even-numbered priority as follows.

Here, for convenience of description, it is assumed that a plurality of rotating devices included in a group $G_{j+1}$ with an even-numbered priority are also rotating devices 14-1 to 14-M.

In addition, it is assumed that element antennas each rotated by a corresponding one of the rotating devices 14-1 to 14-M are element antennas 11-1 to 11-M, and the importance levels of the element antennas 11-1 to 11-M are $I_1$ to $I_M$.

In addition, the scale of the importance levels $I_1$ to $I_M$ is also as follows: among the importance levels $I_1$ to $I_M$, the importance level $I_1$ is highest, the importance level $I_2$ is second highest, and the importance level $I_M$ is lowest.

$$I_1 > I_2 > \ldots > I_M$$

The classifying unit 41 assigns, as allocation numbers k for the rotating devices 14-1 to 14-M included in the group $G_{j+1}$, allocation numbers corresponding to ascending order of the importance levels $I_1$ to $I_M$ of the element antennas 11-1 to 11-M rotated by the rotating devices 14-1 to 14-M, respectively.

Namely, the classifying unit 41 assigns the allocation number "M" (k=M) to the rotating device 14-1 that rotates the element antenna 11-1 with the highest importance level $I_1$.

The classifying unit 41 assigns the allocation number "(M−1)" (k=M−1) to the rotating device 14-2 that rotates the element antenna 11-2 with the second highest importance level $I_2$.

In addition, the classifying unit 41 assigns the allocation number "1" (k=1) to the rotating device 14-M that rotates the element antenna 11-M with the lowest importance level $I_M$.

When the rotation instructing unit 42 receives results of the classification from the classifying unit 41, the rotation instructing unit 42 checks whether or not unselected groups remain among the plurality of groups with different priorities.

If unselected groups remain, the rotation instructing unit 42 selects a group with the highest priority among the unselected groups by referring to the results of the classification.

Here, for convenience of description, it is assumed that the rotation instructing unit 42 selects the first group $G_1$ with an odd-numbered priority.

When the rotation instructing unit 42 selects the first group $G_1$, the rotation instructing unit 42 checks all rotating devices included in the group $G_1$ by referring to the results of the classification. The rotating devices included in the group $G_1$ are hereinafter represented as $sel_{1,k}$ (k=1, 2, . . . , M).

The rotation instructing unit 42 generates control signals $C_{1,1}$ to $C_{1,M}$ that simultaneously drive the rotating devices $sel_{1,1}$ to $sel_{1,M}$ included in the group $G_1$.

The rotation instructing unit 42 outputs the control signals $C_{1,1}$ to $C_{1,M}$ to rotation driving units, among the rotation driving units 15-1 to 15-N, that are connected to the rotating devices $sel_{1,1}$ to $sel_{1,M}$.

When rotation of an element antenna rotated by, for example, a rotating device $sel_{1,e}$ among the rotating devices $sel_{1,1}$ to $sel_{1,M}$ is completed, the rotation instructing unit 42 checks a plurality of rotating devices included in a group $G_2$ whose priority is lower by one level than the group $G_1$.

The rotating device $sel_{1,e}$ is a rotating device that is assigned the allocation number "e" (1≤e≤M) (k=e) and that rotates an element antenna with the eth highest importance level.

Note that, among the rotating devices $sel_{1,1}$ to $sel_{1,M}$ included in the group $G_1$, a rotating device that rotates an element antenna 11-*n* with the smallest amount of rotation $\theta_n$ is the rotating device $sel_{1,M}$. Therefore, among the rotating devices $sel_{1,1}$ to $sel_{1,M}$, a rotating device whose corresponding element antenna 11-*n* completes its rotation first is the rotating device $sel_{1,M}$, and a rotating device whose corresponding element antenna 11-*n* completes its rotation next is a rotating device $sel_{1,M-1}$. Then, a rotating device whose corresponding element antenna 11-*n* completes its rotation last is the rotating device $sel_{1,1}$.

The rotating devices included in the group $G_2$ are hereinafter represented as $sel_{2,k}$ (k=1, 2, . . . , M).

The rotation instructing unit 42 identifies a rotating device $sel_{2,e}$, among the rotating devices $sel_{2,1}$ to $sel_{2,M}$, that has the same allocation number (k=e) as the rotating device $sel_{1,e}$ whose corresponding element antenna has completed its rotation.

The rotating device $sel_{2,e}$ is a rotating device that is assigned the allocation number "e" (1≤e≤M) (k=e) and that rotates an element antenna with the eth lowest importance level.

It is assumed that, among the rotating devices $sel_{1,1}$ to $sel_{1,M}$ included in the group $G_1$, the rotating device $sel_{1,e}$ whose corresponding element antenna has completed its rotation is, for example, the rotating device $sel_{1,M}$. In this example, the rotating device $sel_{2,e}$ is the rotating device $sel_{2,M}$, among the rotating devices $sel_{2,1}$ to $sel_{2,M}$, that rotates an element antenna with the highest importance level.

The rotation instructing unit 42 generates a control signal $C_{2,e}$ that drives the rotating device $sel_{2,e}$, and outputs the control signal $C_{2,e}$ to a rotation driving unit, among the rotation driving units 15-1 to 15-N, that is connected to the rotating device $sel_{2,e}$.

When the rotation driving unit connected to the rotating device $sel_{2,e}$ receives the control signal $C_{2,e}$ from the rotation instructing unit 42, the rotation driving unit drives the rotating device $sel_{2,e}$ included in the group $G_2$.

Then, the rotation driving unit controls the amount of rotation of the rotating device $sel_{2,e}$ in accordance with the control signal $C_{2,e}$.

Among the N element antennas 11-1 to 11-N, an element antenna connected to the rotating device $sel_{2,e}$ is rotated by the rotating device $sel_{2,e}$.

In the above-described third embodiment, the array antenna device 1 is configured in such a manner that, when rotation of an element antenna rotated by any one of rotating devices included in a selected group is completed, the rotation instructing unit 42 drives a rotating device that is one of a plurality of rotating devices included in a group whose priority is lower by one level than the group and that has the same allocation number as the rotating device whose corresponding element antenna has completed its rotation. Thus, the array antenna device 1 of the third embodiment can further reduce the time required to complete rotation of the element antennas 11-1 to 11-N than the array antenna device 1 of the first embodiment.

Fourth Embodiment

In the array antenna device 1 of the first embodiment, there is shown the array antenna device 1 in which the rotation instructing unit 20 drives the rotating devices 14-1 to 14-N.

A fourth embodiment describes an array antenna device 1 in which a rotation instructing unit 52 drives only a rotating device, among the rotating devices 14-1 to 14-N, that rotates an element antenna whose importance level is higher than an importance level threshold.

Figure 19:
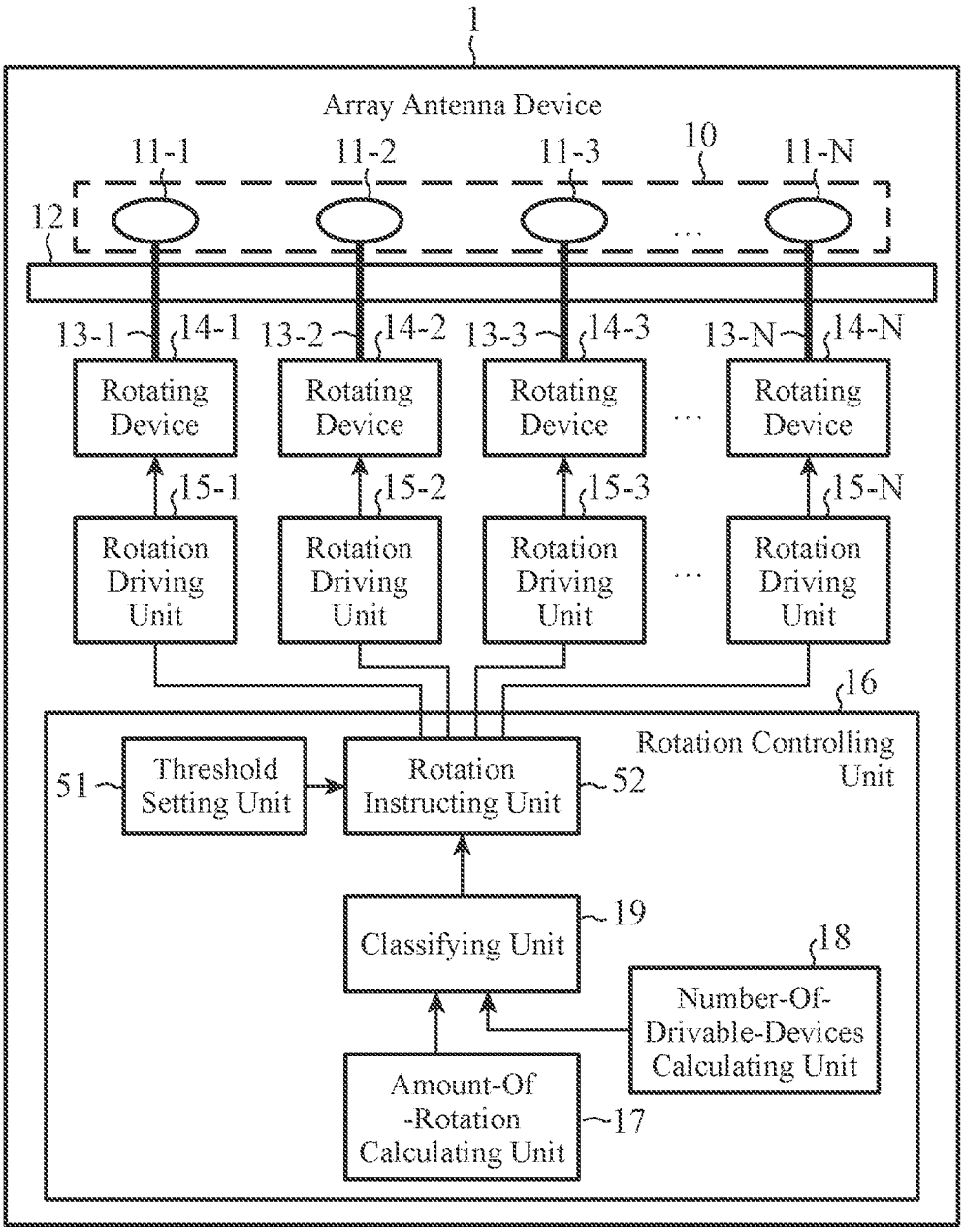
FIG. 19 is a configuration diagram showing an array antenna device of a fourth embodiment.

FIG. 19 is a configuration diagram showing an array antenna device of the fourth embodiment.

In FIG. 19, the same reference signs as those in FIGS. 2 and 16 indicate the same or corresponding portions and thus description thereof is omitted.

The rotation controlling unit 16 includes the amount-of-rotation calculating unit 17, the number-of-drivable-devices calculating unit 18, the classifying unit 19, a threshold setting unit 51, and the rotation instructing unit 52.

The threshold setting unit 51 includes an interface that accepts the setting of an importance level threshold $I_{Th}$, and outputs the importance level threshold $I_{Th}$ to the rotation instructing unit 52.

As with the rotation instructing unit 20 shown in FIG. 2, the rotation instructing unit 52 selects groups in descending order of priority from among a plurality of groups by referring to results of classification outputted from the classifying unit 19.

Each time the rotation instructing unit 52 selects one group, the rotation instructing unit 52 generates a control signal that drives a rotating device included in the group.

Note, however, that unlike the rotation instructing unit 20 shown in FIG. 2, the rotation instructing unit 52 generates a control signal that drives only a rotating device, among a plurality of rotating devices included in the selected group, that rotates an element antenna whose importance level is higher than the importance level threshold $I_{Th}$.

Next, operation of the array antenna device 1 shown in FIG. 19 will be described.

Components other than the threshold setting unit 51 and the rotation instructing unit 52 are the same as those of the array antenna device 1 shown in FIG. 2 and the array antenna device 1 shown in FIG. 16, and thus, here, only operation of the threshold setting unit 51 and the rotation instructing unit 52 will be described.

The threshold setting unit 51 accepts the setting of an importance level threshold $I_{Th}$, for example, by a user's input operation, and saves the importance level threshold $I_{Th}$ in an internal memory.

Here, the threshold setting unit 51 accepts the setting of an importance level threshold $I_{Th}$ by a user's input operation. However, this is merely an example and, for example, an importance level threshold $I_{Th}$ may be provided to the threshold setting unit 51 from an external source by communication.

When the rotation instructing unit 52 receives results of classification from the classifying unit 19, as with the rotation instructing unit 20 shown in FIG. 2, the rotation instructing unit 52 checks whether or not unselected groups remain among a plurality of groups with different priorities.

As with the rotation instructing unit 20 shown in FIG. 2, if unselected groups remain, the rotation instructing unit 52 selects a group with the highest priority among the unselected groups.

When the rotation instructing unit 52 selects one group, the rotation instructing unit 52 checks all rotating devices included in the selected one group by referring to the results of classification.

Here, for convenience of description, the group selected by the rotation instructing unit 52 is represented as $G_{sel}$, and the rotating devices included in the group $G_{sel}$ are represented as $sel_1$ to $sel_M$.

The rotation instructing unit 52 compares the importance levels $I_m$ (m=1, 2, . . . , M) of element antennas each rotated by a corresponding one of the rotating devices $sel_1$ to $sel_M$ with the importance level threshold $I_{Th}$.

The rotation instructing unit 52 identifies a rotating device, among the rotating devices $sel_1$ to $sel_M$, that rotates an element antenna whose importance level $I_m$ is higher than the importance level threshold $I_{Th}$.

The rotation instructing unit 52 generates a control signal that drives the rotating device that rotates the element antenna whose importance level $I_m$ is higher than the importance level threshold $I_{Th}$, and outputs the control signal to a rotation driving unit connected to the rotating device.

Therefore, the rotation instructing unit 52 does not drive a rotating device that rotates an element antenna whose importance level $I_m$ is less than or equal to the importance level threshold $I_{Th}$.

By the rotation instructing unit 52 not driving a rotating device that rotates an element antenna whose importance level $I_m$ is less than or equal to the importance level threshold $I_{Th}$, there is a possibility that the shape of a beam pattern or the radiation intensity of a main beam slightly degrades over a case in which all rotating devices $sel_1$ to $sel_M$ are driven.

However, by the rotation instructing unit 52 not driving a rotating device that rotates an element antenna whose importance level $I_m$ is less than or equal to the importance level threshold $I_{Th}$, the time required to complete rotation of element antennas can be reduced over a case in which all rotating devices $sel_1$ to $sel_M$ are driven.

Fifth Embodiment

In the array antenna device 1 of the first embodiment, when unselected groups remain, the rotation instructing unit 20 selects a group with the highest priority among the unselected groups.

A fifth embodiment describes an array antenna device 1 in which a rotation instructing unit 62 selects only a group whose priority is higher than a priority threshold among unselected groups.

Figure 20:
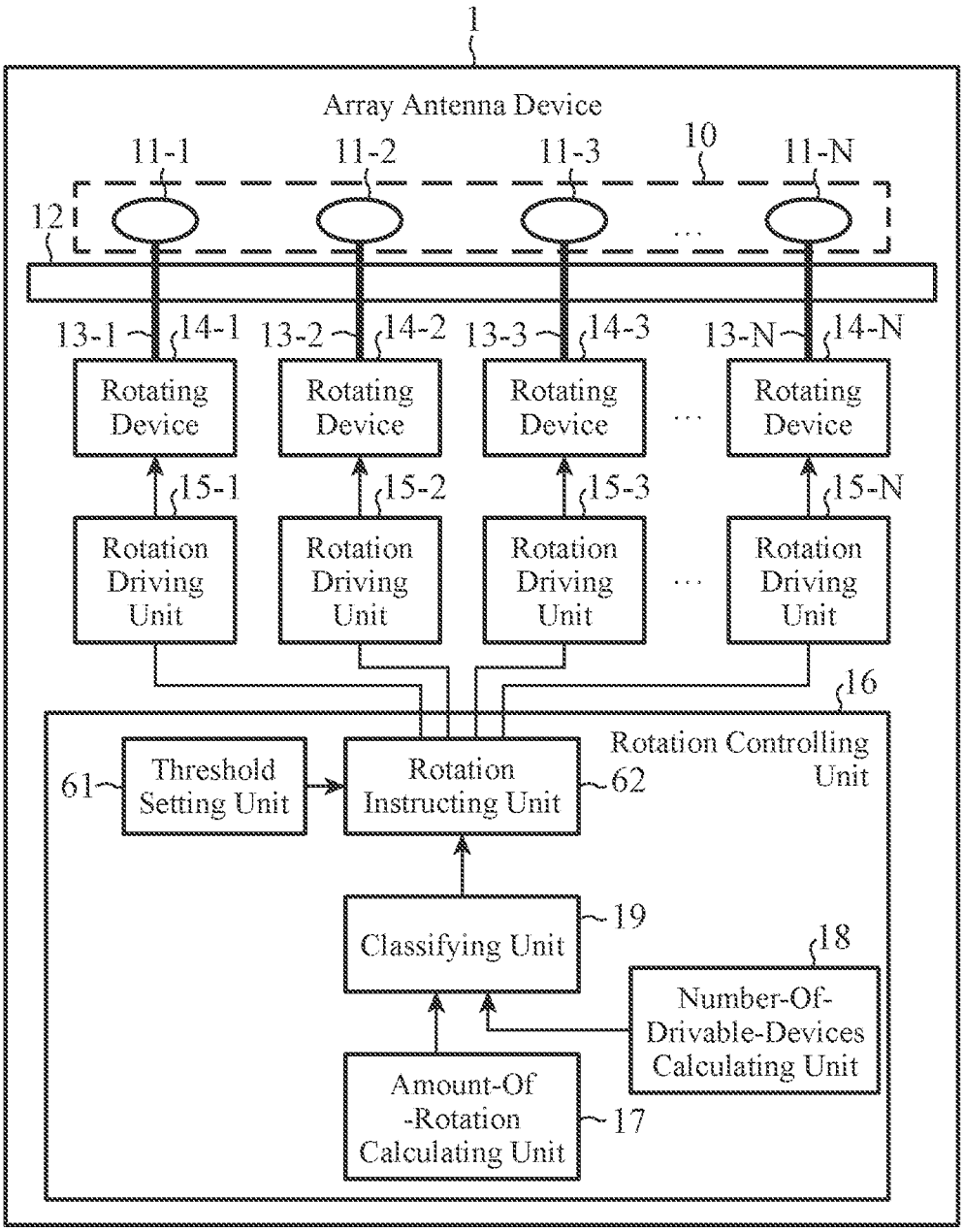
FIG. 20 is a configuration diagram showing an array antenna device of a fifth embodiment.

FIG. 20 is a configuration diagram showing an array antenna device of the fifth embodiment.

In FIG. 20, the same reference signs as those in FIGS. 2 and 16 indicate the same or corresponding portions and thus description thereof is omitted.

The rotation controlling unit 16 includes the amount-of-rotation calculating unit 17, the number-of-drivable-devices calculating unit 18, the classifying unit 19, a threshold setting unit 61, and the rotation instructing unit 62.

The threshold setting unit 61 includes an interface that accepts the setting of a priority threshold $G_{Th}$, and outputs the priority threshold $G_{Th}$ to the rotation instructing unit 62.

As with the rotation instructing unit 20 shown in FIG. 2, the rotation instructing unit 62 selects groups in descending order of priority from among a plurality of groups by referring to results of classification outputted from the classifying unit 19.

Note, however, that unlike the rotation instructing unit 20 shown in FIG. 2, the rotation instructing unit 62 selects only a group whose priority is higher than the priority threshold $G_{Th}$.

Each time the rotation instructing unit 62 selects one group, the rotation instructing unit 62 generates control signals that simultaneously drive all rotating devices included in the group.

The rotation instructing unit 62 outputs the generated control signals to rotation driving units, among the rotation driving units 15-1 to 15-N, that are connected to all rotating devices included in the selected group.

Next, operation of the array antenna device 1 shown in FIG. 20 will be described.

Components other than the threshold setting unit 61 and the rotation instructing unit 62 are the same as those of the array antenna device 1 shown in FIG. 2 and the array antenna device 1 shown in FIG. 16, and thus, here, only operation of the threshold setting unit 61 and the rotation instructing unit 62 will be described.

The threshold setting unit 61 accepts the setting of a priority threshold $G_{Th}$, for example, by a user's input operation, and saves the priority threshold $G_{Th}$ in an internal memory.

Here, the threshold setting unit 61 accepts the setting of a priority threshold $G_{Th}$ by a user's input operation. However, this is merely an example and, for example, a priority threshold $G_{Th}$ may be provided to the threshold setting unit 61 from an external source by communication.

When the rotation instructing unit 62 receives results of classification from the classifying unit 19, as with the rotation instructing unit 20 shown in FIG. 2, the rotation instructing unit 62 checks whether or not unselected groups remain among a plurality of groups with different priorities.

As with the rotation instructing unit 20 shown in FIG. 2, if unselected groups remain, the rotation instructing unit 62 selects a group with the highest priority among the unselected groups.

Note, however, that unlike the rotation instructing unit 20 shown in FIG. 2, the rotation instructing unit 62 selects only a group whose priority is higher than the priority threshold $G_{Th}$.

For example, when the priority threshold $G_{Th}$ is 5, if any of groups whose priorities are 1 to 4 remains among the unselected groups, the rotation instructing unit 62 selects a group with the highest priority among the remaining groups.

If none of the groups whose priorities are 1 to 4 remains among the unselected groups, the rotation instructing unit 62 does not select one group.

When the rotation instructing unit 62 selects one group, as with the rotation instructing unit 20 shown in FIG. 2, the rotation instructing unit 62 checks all rotating devices included in the selected one group by referring to the results of classification.

As with the rotation instructing unit 20 shown in FIG. 2, the rotation instructing unit 62 generates control signals that drive rotating devices included in the selected group, and outputs the control signals to rotation driving units connected to the rotating devices included in the group Therefore, the rotation instructing unit 62 does not drive rotating devices included in a group whose priority is less than or equal to the priority threshold $G_{Th}$.

By the rotation instructing unit 62 not driving rotating devices included in a group whose priority is less than or equal to the priority threshold $G_{Th}$, there is a possibility that the shape of a beam pattern or the radiation intensity of a main beam slightly degrades over a case in which the rotating devices included in all groups are driven.

However, by the rotation instructing unit 62 not driving rotating devices included in a group whose priority is less than or equal to the priority threshold $G_{Th}$, the time required to complete rotation of element antennas can be reduced over a case in which the rotating devices included in all groups are driven.

Note that in the invention of this application, a free combination of the embodiments, modifications to any component of the embodiments, or omissions of any component in the embodiments are possible within the scope of the invention.

INDUSTRIAL APPLICABILITY

The invention is suitable for an array antenna device including an array antenna.

In addition, the invention is suitable for a communication device including the array antenna device.

REFERENCE SIGNS LIST

1: array antenna device, 2: communicator, 10: array antenna, 11-1 to 11-N: element antenna, 12: feeding unit, 13-1 to 13-N: rotating shaft, 14-1 to 14-N: rotating device, 15-1 to 15-N: rotation driving unit, 16: rotation controlling unit, 17: amount-of-rotation calculating unit, 18: number-of-drivable-devices calculating unit, 19, 30, 41: classifying unit, 20, 42, 52, 62: rotation instructing unit, and 51, 61: threshold setting unit

The invention claimed is:

1. An array antenna device comprising:

an array antenna including a plurality of element antennas;

a plurality of rotating devices for each rotating a corresponding one of the plurality of element antennas; and processing circuitry to calculate the number of rotating devices that are simultaneously drivable from maximum allowed current consumption of the entire device and current consumption of each of the plurality of rotating devices;

classify the plurality of rotating devices into a plurality of groups with different priorities under a condition that the number of rotating devices included in one group is equal to or less than the number of rotating devices that is calculated; and select groups in descending order of priority from among the plurality of groups and drive, each time one group is selected, all rotating devices included in the group, wherein the processing circuitry performs the classification in such a manner that, among the plurality of rotating devices, a rotating device that rotates an element antenna with a higher importance level is classified into a group with a higher priority.

2. The array antenna device according to claim 1, wherein the processing circuitry determines each of importance levels of the plurality of element antennas from each of amounts of rotation of the plurality of element antennas.

3. The array antenna device according to claim 2, wherein the processing circuitry determines that, among the plurality of element antennas, an element antenna with a larger amount of rotation has a higher value of importance level.

4. The array antenna device according to claim 1, wherein the processing circuitry determines an importance level of each of the plurality of element antennas from a distance between a center position of the plurality of element antennas and a position of the each of the plurality of element antennas.

5. The array antenna device according to claim 4, wherein the processing circuitry determines that, among the plurality of element antennas, an element antenna with a shorter distance has a higher value of importance level.

6. The array antenna device according to claim 2, wherein the processing circuitry:

assigns, as allocation numbers for a plurality of rotating devices included in a group with an odd-numbered priority among the plurality of groups, allocation numbers corresponding to descending order of importance levels of element antennas each rotated by a corresponding one of the plurality of rotating devices included in the group with the odd-numbered priority; and assigns, as allocation numbers for a plurality of rotating devices included in a group with an even-numbered priority among the plurality of groups, allocation numbers corresponding to ascending order of importance levels of element antennas each rotated by a corresponding one of the plurality of rotating devices included in the group with the even-numbered priority, and when rotation of an element antenna rotated by any one of the rotating devices included in the selected group is completed, the processing circuitry drives a rotating device that is one of a plurality of rotating devices included in a group whose priority is lower by one level than priority of the selected group and that has a same allocation number as the rotating device whose corresponding element antenna has completed rotation.

7. The array antenna device according to claim 1, wherein the processing circuitry drives a rotating device, among the plurality of rotating devices, that rotates an element antenna whose importance level is higher than an importance level threshold, and does not drive a rotating device that rotates an element antenna whose importance level is less than or equal to the importance level threshold.

8. The array antenna device according to claim 1, wherein the processing circuitry selects a group whose priority is higher than a priority threshold from among the plurality of groups, and does not select a group whose priority is less than or equal to the priority threshold.

9. A communication device that performs wireless communication using an array antenna device, wherein the array antenna device includes:

an array antenna including a plurality of element antennas;

a plurality of rotating devices for each rotating a corresponding one of the plurality of element antennas; and processing circuitry to calculate the number of rotating devices that are simultaneously drivable from maximum allowed current consumption of the entire device and current consumption of each of the plurality of rotating devices;

classify the plurality of rotating devices into a plurality of groups with different priorities under a condition that the number of rotating devices included in one group is equal to or less than the number of rotating devices that is calculated; and select groups in descending order of priority from among the plurality of groups and drive, each time one group is selected, all rotating devices included in the group, and the processing circuitry performs the classification in such a manner that, among the plurality of rotating devices, a rotating device that rotates an element antenna with a higher importance level is classified into a group with a higher priority.

* * * * *